US012662843B2

(12) United States Patent
Wu

(10) Patent No.: US 12,662,843 B2
(45) Date of Patent: Jun. 23, 2026

(54) COLLAPSIBLE STRUCTURE FOR SHELTER

(71) Applicant: Ningbo CasualWay Leisure Products Co., Ltd., Zhejiang (CN)

(72) Inventor: Guoxiang Wu, Zhejiang (CN)

( * ) Notice: Subject to any disclaimer, the term of this patent is extended or adjusted under 35 U.S.C. 154(b) by 310 days.

(21) Appl. No.: 18/461,494

(22) Filed: Sep. 5, 2023

(65) Prior Publication Data

US 2024/0076899 A1 Mar. 7, 2024

(30) Foreign Application Priority Data

Sep. 6, 2022 (CN) ..... 202211084839.9
Nov. 10, 2022 (CN) ..... 202223000030.1

(51) Int. Cl.
*E04H 15/50* (2006.01)

(52) U.S. Cl.
CPC ..... *E04H 15/50* (2013.01)

(58) Field of Classification Search
CPC ..... E04H 15/50
See application file for complete search history.

(56) References Cited

U.S. PATENT DOCUMENTS 541,672 A * 6/1895 Pappin ..... G09F 15/0062 248/166
743,827 A * 11/1903 Campbell ..... E04H 15/48 135/154
2,924,414 A * 2/1960 Tesdal ..... F16M 11/32 211/206
8,033,289 B2 * 10/2011 Buckley ..... B63B 17/02 135/114
9,003,683 B1 * 4/2015 Feliciano ..... G09F 15/0025 40/610
9,140,030 B2 * 9/2015 Jin ..... E04H 15/42
9,316,019 B2 * 4/2016 Buckley ..... E04H 15/46
9,784,009 B2 * 10/2017 Choi ..... E04H 15/48
9,845,614 B2 * 12/2017 Huang ..... E04H 15/52
10,508,466 B2 * 12/2019 Huang ..... E04H 15/46
2013/0068269 A1 * 3/2013 Gao ..... E04H 15/50 135/145
2015/0068573 A1 * 3/2015 Jin ..... E04H 15/46 135/147

* cited by examiner

*Primary Examiner* — David R Dunn
*Assistant Examiner* — Danielle Jackson
(74) *Attorney, Agent, or Firm* — Hawaii Patent Services; Nathaniel K. Fedde; Kenton N. Fedde

(57) ABSTRACT

The present invention discloses a collapsible structure having at least two standing frames connected by an extendable linkage. Each standing frame comprises at least two standing poles. Two standing poles are pivotally connected to each other by a pivot point. The standing frame also includes a linking device that enables two standing poles to be folded or unfolded. The extendable linkage connected to two adjacent standing frames comprises at least one extendable link assembly capable of adjusting the distance of its two ends. The collapsible structure also includes a locking device and telescoping tubes.

16 Claims, 19 Drawing Sheets

COLLAPSIBLE STRUCTURE FOR SHELTER

RELATED APPLICATION

This application claims priority to Chinese patent application No. 202211084839.9, filed Sep. 6, 2022, and Chinese patent application No. 202223000030.1, filed Nov. 10, 2022, the entire contents each of which is herein incorporated by reference.

TECHNICAL FIELD

The present invention relates to the technical field of collapsible and portable structures and particularly relates to a collapsible structure for shelter.

BACKGROUND

People appreciate the collapsible structure because it is compact and easy to transport when closed. It is commonly used for outdoor sunshade devices, hanging devices, folding traffic isolation frames, display devices, and more. For example, a typical sunshade device, like a tarp, folding gazebo, or camping tent, has a canvas and supporting structure. The canvas is connected to the supporting structure, providing shelter from the sun and wind. While these devices bring comfort to outdoor life, people want them to be even better. They should be adaptable to various sites or venues, stable and free-standing, portable, and easy for one person to set up or take down.

In practical use, outdoor sunshade devices in prior art have some shortcomings. For instance, a tarp requires two or more supporting poles to keep it up, which are assembled through an insert connection. Guy ropes are then used to tie the four corners and reach out to ground stakes for fixing, which takes up a lot of space. Unfortunately, the ground stakes can only be fixed to soft land like grassland or sand soil, making the tarp less versatile. It also requires multiple people to set up, making it inconvenient. A folding gazebo is another example that has four telescopic posts and an X-shaped truss framework to connect adjacent posts. It can stand on its feet after extension. However, excessive connections between the top frame and perimeter truss framework may cause interference, leading to operational inconvenience. It usually requires at least two people to operate synchronously to take the four posts close up. The process is laborious, and it is usually bulky and heavy, making it difficult to carry around. A large tent as another example, when closed, is compact. However, to set it up, the user needs to build a large, rigid frame to brace the tent fabric, which is troublesome and time-consuming. It takes labor to knock it down after each use by dismantling all the poles and connections, making it a poor experience for ordinary users. Finally, a small camping tent, as another example, commonly found in daily life usually has a flexible frame made of fiberglass and covered by tent fabric. However, it is usually low in height, relatively poor for stability, and weak in self-standing. It usually needs lots of guy ropes and ground stakes to peg it down and therefore it's usually not able to be used on hard surfaces.

Prior art hanging devices, collapsible traffic barriers, and display devices often suffer from either structural complexity or time-consuming and tedious unfolding and folding operations.

SUMMARY

Briefly, and in general terms, the present invention provides for a collapsible structure with higher adaptability to all kinds of venues with either soft or hard surfaces, free-standing, easier to deploy, and highly portable.

The present invention offers a collapsible structure consisting of at least two standing frames with extendable linkages connecting them. The linkages allow the frames to close or extend as needed. Each standing frame has two poles—the first and second standing poles—which are connected at the top by a pivot point. The poles can rotate around this pivot point, allowing them to fold or unfold. Additionally, a sliding member is assembled on the first standing pole, allowing it to slide along the pole. The standing frame also has a link pole, which is pivotally connected to the sliding member and the second standing pole. When the first standing pole folds towards the second standing pole, the link pole rotates around its second end, causing the sliding member to slide away from the pivot point and the poles to fold up completely. When the first standing pole opens up from the second standing pole, the link pole rotates accordingly on its second end, and the sliding member slides towards the pivot point, causing the poles to completely unfold.

The present invention offers a collapsible structure consisting of two standing frames. Each frame has two standing poles—the first and second standing poles. The top ends of these poles are connected by the first pivot point. Additionally, each standing frame includes a first bracing pole and a second bracing pole, which are pivotally connected to the first and second standing poles, respectively. The inner ends of the bracing poles are connected by the second pivot point. An extendable linkage is provided between adjacent standing frames to allow them to close or extend. One end of the extendable linkage is connected to the first pivot point of one standing frame, while the other end is connected to the first pivot of the other standing frame.

The present invention offers a collapsible structure that has a pair of standing frames. Each standing frame consists of two standing poles: the first and the second standing poles. The top ends of these poles are connected through the first pivot point. Additionally, each standing frame includes a first bracing pole and a second bracing pole, which are pivotally connected to the first and second standing poles, respectively. The inner ends of the bracing poles are connected by the second pivot point. An extendable linkage is provided between adjacent standing frames to allow them to close or extend. The first end of the extendable linkage is linked to the first and second pivot points of one standing frame, and the second end is linked to the first and second pivot points of another standing frame. When the linkage folds, it drives the second pivot points away from the first pivot points, causing the bracing poles and standing poles to rotate and fold accordingly. When the linkage unfolds, it drives the second pivot point towards the first pivot point, causing the bracing poles and standing poles to rotate and unfold accordingly.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Embodiment I

Figure 1:
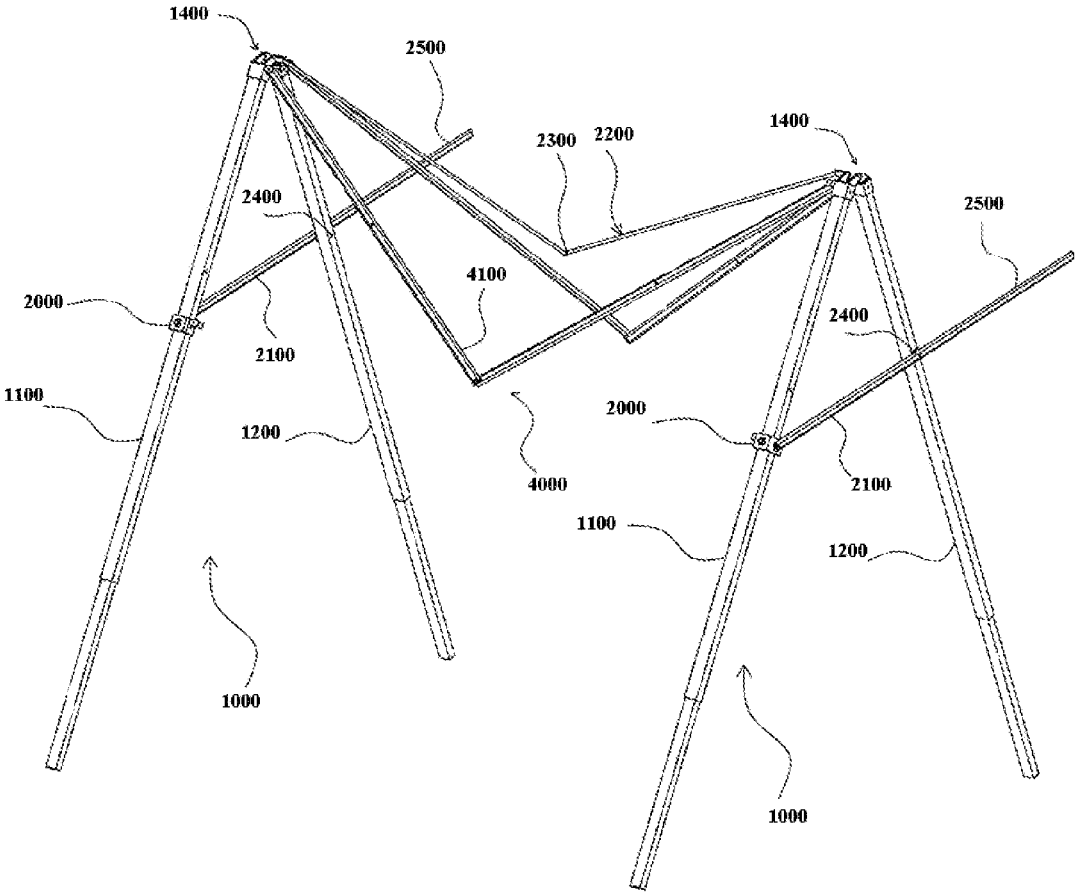
FIG. 1 shows a schematic view I of embodiment I.
Figure 2:
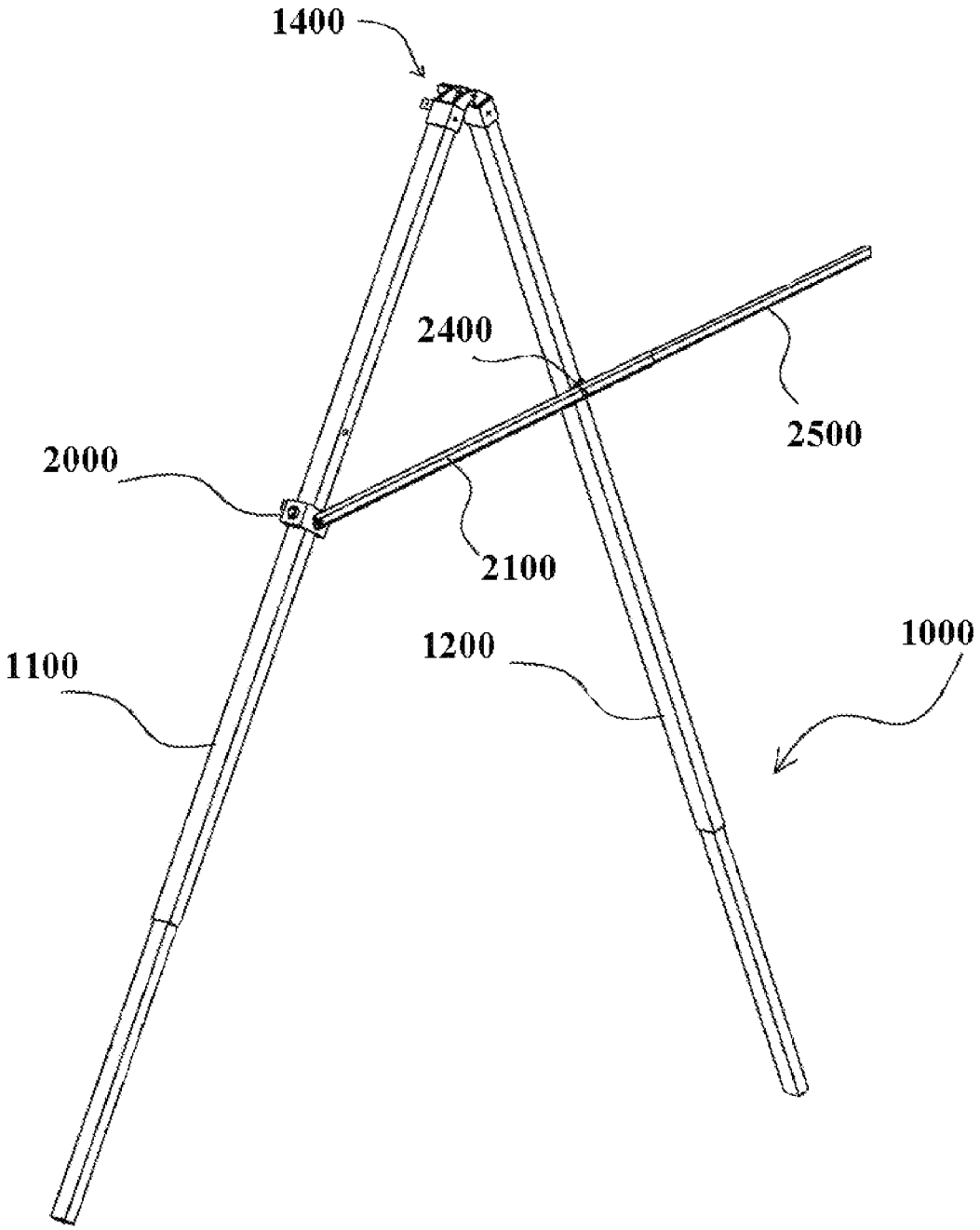
FIG. 2 shows a schematic view II of embodiment I.
Figure 3:
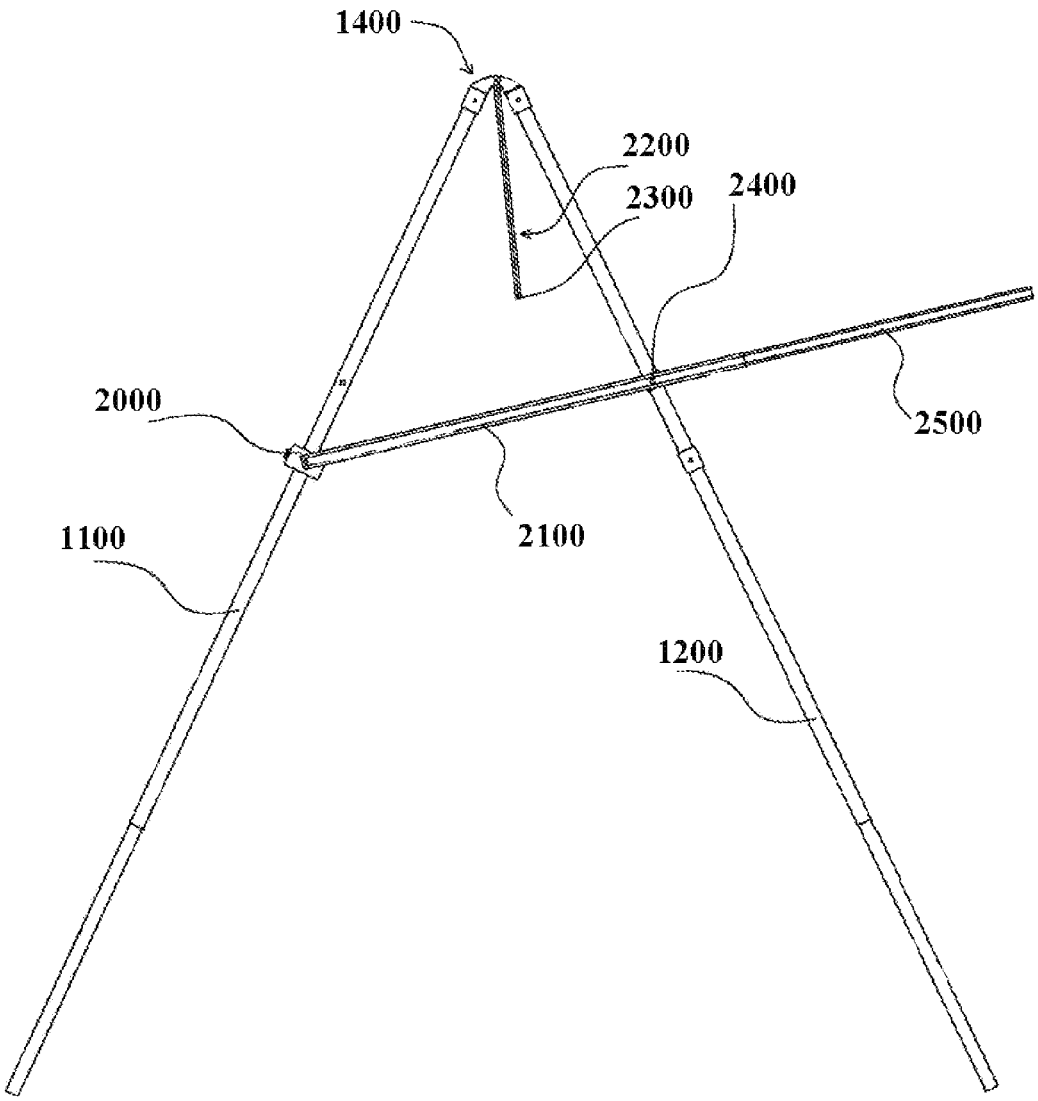
FIG. 3 shows a schematic view III of embodiment I.

As shown in FIGS. 1 to 3;

This embodiment of the present invention discloses a collapsible structure that includes a pair of standing frames 1000 and an extendable linkage 4000 between them. The extendable linkage 4000 allows the standing frames 1000 to be closed up or extended out.

Specifically, as shown in FIGS. 1 to 3, the extendable linkage 4000 is a type of linking framework that adjusts the distance between the standing frames 1000. In this embodiment, the extendable linkage is made up of at least one extendable link assembly 4100. Each extendable link assembly 4100 is made up of two segments that are pivotally coupled in the middle pivot point. This allows the extendable link assembly 4100 to fold or unfold via the middle pivot point which can be locked when unfolded. The two ends of the extendable link assembly 4100 are pivotally linked to the first pivot points 1400 of the two adjacent standing frames 1000, which can also be locked when unfolded.

In this embodiment, the pivotal connection may be a pivotal connection by means of a pivot pin, a pivotal knuckle, a pivot, a hinge, etc. Additionally, to reinforce the structural stability of the collapsible structure, two extendable link assemblies 4100 are placed on both sides of the standing frames 1000. This makes the overall structure more solid and resistant to wind.

As shown in FIG. 1, in this embodiment, a top pole 2200 positioned between two adjacent standing frames 1000. The two ends of the top pole 2200 are pivotally connected to each first pivot point 1400 at the top of each adjacent standing frame 1000. The foldable top pole 2200 features a middle section pivoted through a rotation member 2300. When the rotation member 2300 is pulled downward, the top pole 2200 folds, and its ends move closer.

In this embodiment, the top pole 2200 reinforces the structural stability of the standing frame 1000. By folding or unfolding the top pole 2200, user can easily collapse or expand the structure.

FIGS. 1-3 show that each standing frame 1000 in this embodiment consists of two standing poles: a first standing pole 1100 and a second standing pole 1200. The tops of these poles are connected at a first pivot point 1400, allowing them to pivotally collapse or unfold. Additionally, there is a sliding member 2000 mounted to the first standing pole 1100, which slides along it. the standing frame 1000 also includes a link pole 2100 with its first end pivotably connected to the sliding member 2000 and its second end pivotably connected to the second standing pole 1200 via a linking pivot 2400.

Specifically, As the first standing pole 1100 pivots towards the second standing pole 1200, the link pole 2100 rotates around its second end and the first end of the link pole 2100 drives the sliding member 2000 away from the first pivot point along the first standing pole 1100 until the first and second standing poles are completely folded. When the first standing pole 1100 opens up from the second standing pole 1200, the link pole 2100 rotates accordingly around its second end and the first end of the link pole 2100 drives the sliding member 2000 towards the first pivot point 1400 along the first standing pole 1100 until the first and second standing poles are completely unfolded.

In this embodiment, the sliding member 2000 is a sliding sleeve mounted on the first standing pole 1100, but it can also be a slider within the first standing pole 1100 with at least a portion of the slider exposed to a sliding groove in the sidewall of the first standing pole 1100.

In this embodiment, the first standing pole 1100, the second standing pole 1200 and the link pole 2100 may be hollow metal tubes or hollow plastic tubes, which may be circular, oval, square, etc. in cross section. The first pivot point 1400 is a hinge having an axis of rotation and two arms of rotation which can rotate relative to each other, the hinge being a structure of prior art, and this embodiment is not described in detail.

In this embodiment, the first standing pole 1100, the second standing pole 1200 and the link pole 2100 may be provided as telescoping tubes, for example, an inner pole is slidably fitted in the lower bore of the first standing pole 1100 and the second standing pole 1200, which can be expanded o retracted with respect to the first standing pole 1100 or the second standing pole 1200, thereby adjusting the height of the standing frame 1000. The link pole 2100 may also be provided at least one end with a sliding pole 2500 that extends the length of the link pole 2100 when the standing frame 1000 is used as a tent, and the sliding pole 2500 may be attached to support a canvas or tarp when the standing frame 1000 is used as a tent or canopy.

To utilize the collapsible structure in this embodiment, simply unfurl two adjacent standing frames 1000 and rotate the first standing pole 1100 and the second standing pole 1200 around the first pivot point 1400. This will open the standing frame 1000 and allow it to be self-standing with excellent stability without needing to be fixed to the ground or require a specific installation site, making it versatile for a wide range of uses.

In this embodiment, when folding or unfolding the collapsible structure, it is especially easy. It only requires turning the first standing pole 1100 or the second standing pole 1200, sliding the sliding member 2000, or turning the link pole 2100 since all these parts are linked together for synchronous motion. The structure is simple, lightweight, and portable, making it easy to use, labor-saving, and user-friendly. One person can effortlessly extend or open the standing frame 1000.

Additionally, after each standing frame 1000 is unfolded, the first standing pole 1100, second standing pole 1200, and link pole 2100 form an A-shaped standing frame, which provides triangular stability achieved by the linking structure. This stability helps to withstand wind better. Furthermore, the number of standing frames 1000 can be increased as required, making the length of the collapsible structure adaptable and flexible in size for personal, family or team use.

In this embodiment, there is a sliding member 2000 that comes with a locking device. This device is used to hold the sliding member 2000 in place at any point during its movement. whereby, the locking device secures the sliding member 2000 to the first standing pole 1100. When unlocked, the sliding member 2000 can move up and down the first standing pole 1100. When locked, the sliding member 2000 stays fixed in place. This locking device 3300 was implemented to prevent any accidental unfolding or folding of the standing frame 1000, which ensures a high level of safety during use.

In this embodiment, the locking device can be a cam wrench that pivots onto the sliding member 2000. When rotated, the cam portion of the wrench presses against the first standing pole 1100, securing the sliding member 2000 in place. Alternatively, the locking device can be a spring loaded pin attached to the sliding member 2000, which plugs into the locking hole on the first standing pole 1100 to lock it in place. The locking device is not described in detail in this embodiment since any device capable of securing the sliding member 2000 on the first standing pole 1100 can be utilized.

Embodiment II

Figure 4:
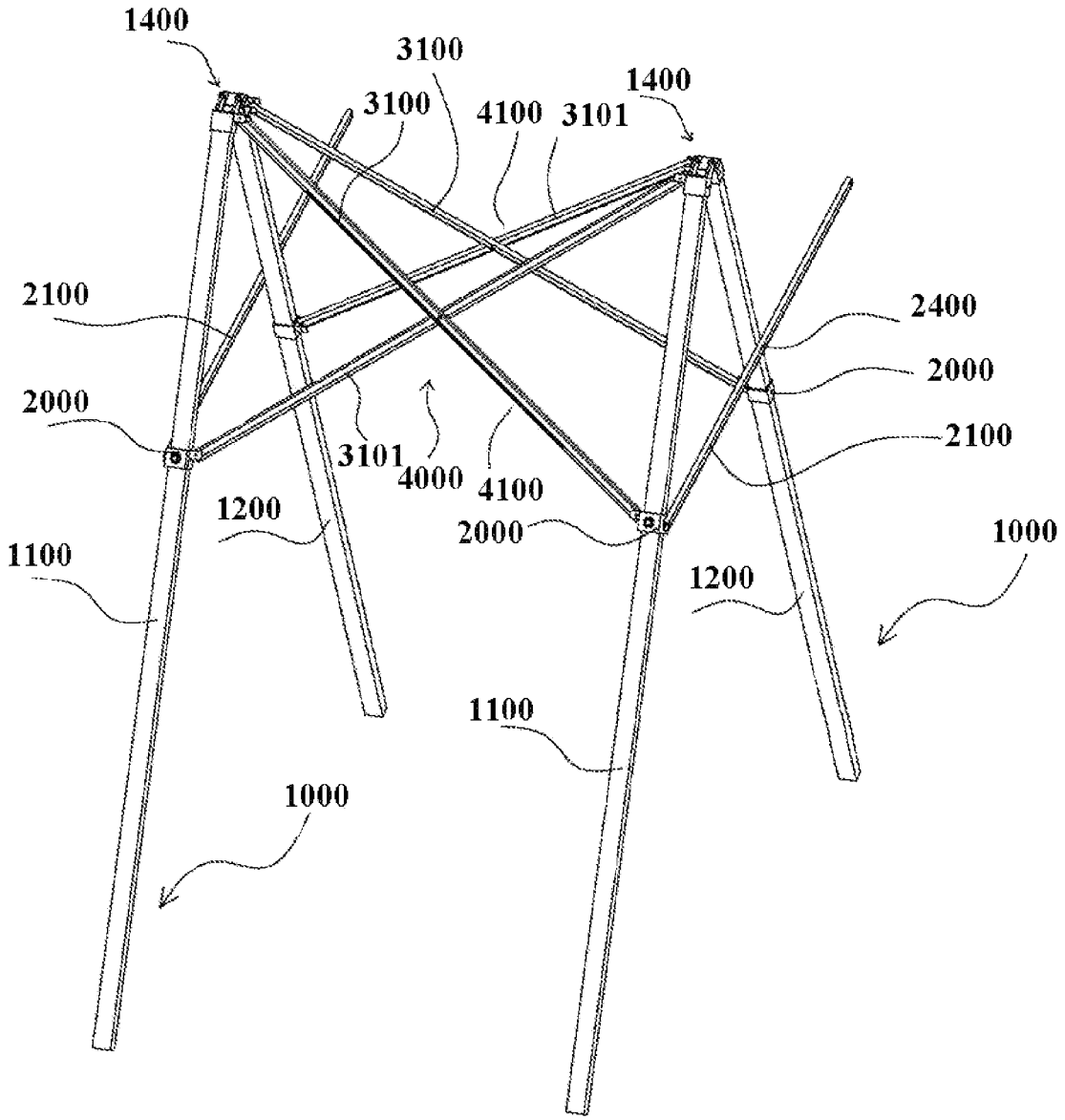
FIG. 4 shows a schematic view of embodiment II.

As shown in FIG. 4, in this embodiment, the extendable linkage 4000 has at least one extendable link assembly 4100 placed on the side of the standing frame 1000 with the first standing pole 1100. The extendable link assembly 4100 consists of at least two link members connected in an X-shaped configuration by a central pivot: the first link member 3100 and the second link member 3101. The first link member 3100 is pivotally connected to the first pivot point 1400 of one standing frame 1000 at its first end and to the sliding member 2000 on the other standing frame 1000 at its second end. The second link member 3101 is pivotally connected to the sliding member 2000 on one standing frame 1000 at its first end and to the first pivot point 1400 of the other standing frame 1000 at its second end.

Specifically, when two adjacent standing frames 1000 move towards or move away from each other, the first link member 3100 and second link member 3101 drive the sliding members 2000 slide accordingly, causing the standing frames 1000 to fold or unfold; Regardless of whether a single sliding member, first link member 3100, second link member 3101, first standing pole 1100, second standing pole 1200, or link pole 2100 moves or rotates by itself, the entire standing frames 1000 folds or unfolds accordingly. This makes one-step opening or closing possible.

As shown in FIG. 4, the extendable linkage 4000 consists of two extendable link assemblies 4100 on either side of the standing frames 1000. Each assembly consists of at least two link members connected in an X-shaped configuration by a central pivot. The first link member 3100 and the second link member 3101 are part of each assembly. In the first extendable link assembly 4100, the first link member 3100 is connected to the first pivot point 1400 of one standing frame 1000 at one end and to the sliding member 2000 on the other standing frame 1000 at the other end. The second link member 3101 is connected to the sliding member 2000 on one standing frame 1000 at one end and to the first pivot point 1400 of the other standing frame 1000 at the other end.

Likewise, in the second extendable link assembly 4100 placed on the other side of the standing frames 1000, the first link member 3100 is connected to the first pivot point 1400 of one standing frame 1000 at one end and to the sliding member 2000 on the other standing frame 1000 at the other end. The second link member 3101 is connected to the sliding member 2000 on one standing frame 1000 at one end and to the first pivot point 1400 of the other standing frame 1000 at the other end. This arrangement increases the collapsible structure's stability, making it more solid and resistant to wind.

In this embodiment, when two adjacent standing frames 1000 fold or unfold, the first standing pole 1100 and the second standing pole 1200 turn against each other and drive the sliding member 2000 to slide along the second standing pole 1200, causing the second extendable link assembly 4100 to fold or unfold synchronously.

Embodiment III

Figure 5:
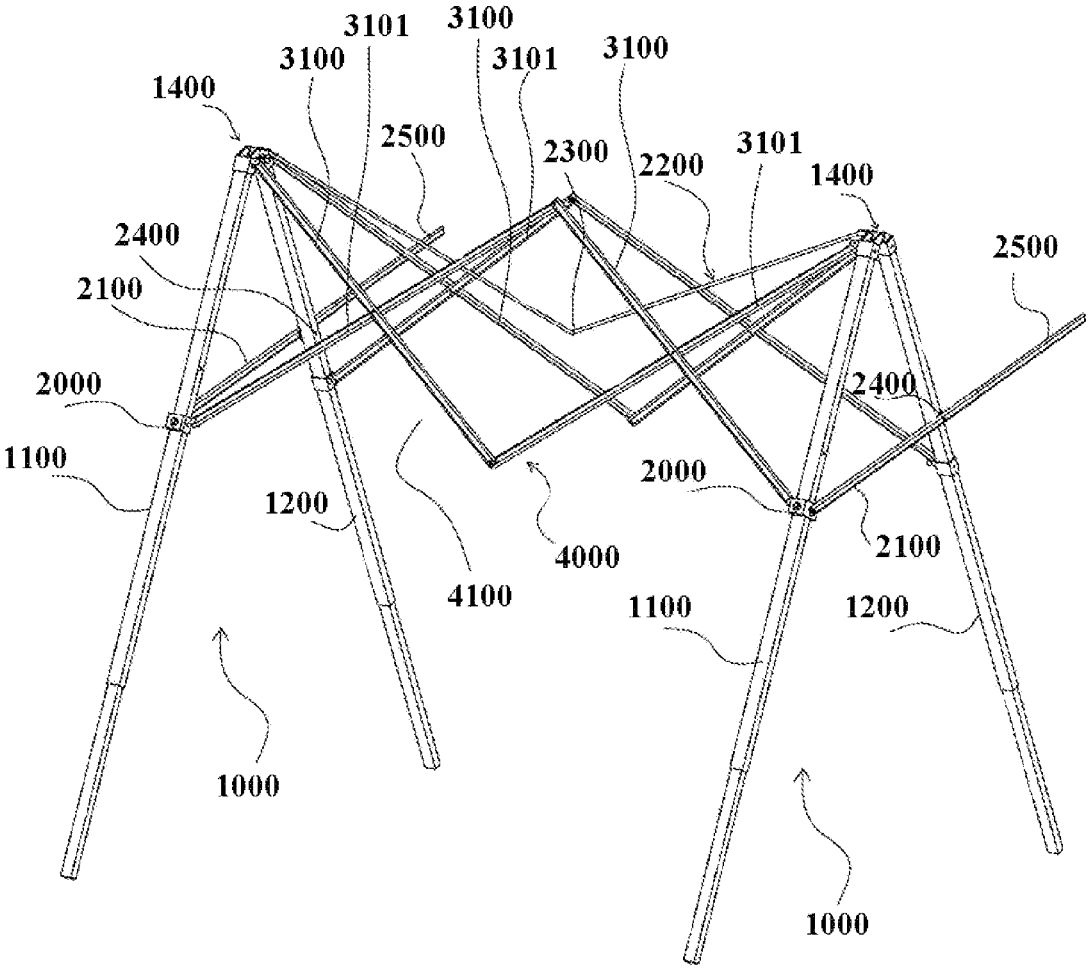
FIG. 5 shows a schematic view I of embodiment III.
Figure 6:
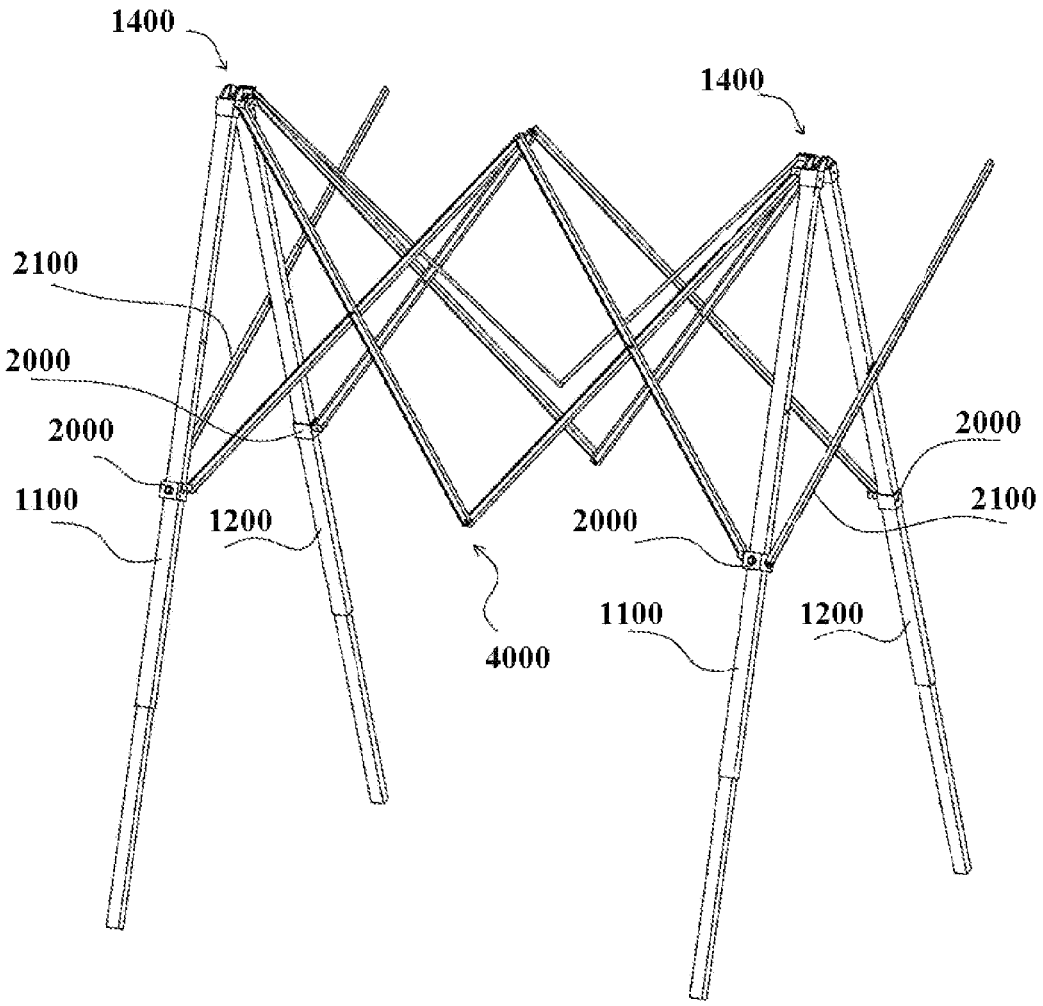
FIG. 6 shows a schematic view II of embodiment III.
Figure 7:
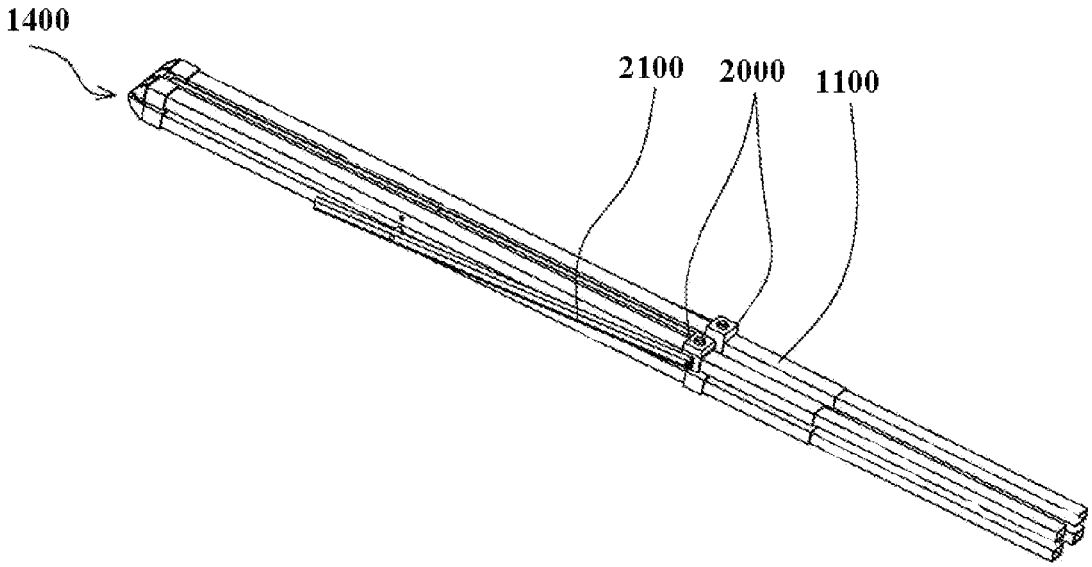
FIG. 7 shows a schematic view III of embodiment

As shown in FIGS. 5 to 7, in this embodiment, each extendable linkage comprises two extendable link assembles 4100: the first extendable link assembly and the second extendable link assembly, each consists of two link members interconnected in an X-shaped configuration by a central pivot: the first link member 3100 and the second link member 3101. The second end of the first link member 3100 from the first extendable link assembly is pivotally connected to the first end of the second link member 3101 from the second extendable link assembly. Additionally, the second end of the second link member 3101 from the first extendable link assembly is pivotally connected to the first end of the first link member 3100 from the second extendable link assembly.

Specifically, with this arrangement, the length of the extendable linkage 4000 can be adjusted based on the user's needs by modifying the quantity of X-shaped extendable link assemblies 4100. This adaptability facilitates various applications of the collapsible structure. In other embodiments, each extendable linkage 4000 may include three, four, or five extendable link assemblies 4100 of equal size. Adjacent extendable link assemblies are connected by pivotally coupling the second end of the first link member 3100 of one extendable link assembly to the first end of the second link member 3101 of the other extendable link assembly, and the second end of the second link member 3101 of one extendable link assembly to the first end of the first link member 3100 of the other extendable link assembly.

As shown in FIG. 5, in this embodiment, a top pole 2200 is positioned between two adjacent standing frames 1000. The top pole 2200's two ends are pivotally connected to each first pivot point 1400 at the top of each adjacent standing frame 1000. The foldable top pole 2200 features a middle section pivoted through a rotation member 2300. When the rotation member 2300 is pulled downward, the top pole 2200 folds, and its ends move closer, collapsing the two adjacent standing frames 1000. Conversely, pushing the rotation member 2300 upward results in the opposite movement, extending the collapsible structure until the top pole is straight horizontally. The top pole 2200 enhances the structural stability of the standing frame 1000 while facilitating user control to easily collapse or expand the structure.

Specifically, this feature is especially useful in small tents with lower overall height as adults can conveniently reach the rotation member 2300 to either push it up to open or pull it down to close the tent. In addition, when two adjacent standing frames are fully unfolded, the top pole 2200 is set horizontally to serve as a roof ridge and support the canopy fabric attached to the collapsible structure when used as a tent, folding gazebo, sunshade shelter, etc.

Wherein the rotation member 2300 of this embodiment may be a joint, hinge, knuckle or other device connected by a pivot that can move downward only when the top pole 2200 is straight in a horizontal position. The rotation member's downward movement results in top pole 2200 folds accordingly. All other structures of this embodiment remain the same as in the above embodiments, and thus further description of this embodiment is unnecessary.

FIGS. 5, 6, and 7 demonstrate the folding process to understand the structure change and component movement. FIG. 6 represents the collapsible structure during closing, whereas FIG. 7 shows the collapsible structure when fully closed. As a result, the collapsible structure occupies less space when closed, making it lightweight and easy to carry.

Additionally, in this embodiment, FIGS. 5 and 6 demonstrate the synchronized motion relationship between all components and their connections. The first standing poles 1100, second standing poles 1200, link poles 2100, sliding members 2000, extendable link assemblies 4100, and so on are all interlinked. The movement of any one component causes a corresponding movement in the others. Users only need to move either of the first standing pole 1100, the second standing pole 1200, or the link pole 2100, or slide either the sliding member 2000 or move the two adjacent standing frames 1000 closer or away from each other. As a result, the collapsible structure will fold or unfold accordingly. This allows for a simple and convenient one-step opening or closing process that can be done by one person Embodiment IIII (not Shown in Figures)

This embodiment is an application of the collapsible structure that can be utilized in a sunshade device. The sunshade device consists of the collapsible structure, which features standing frames with extendable linkage, and a canvas attached to it. This collapsible structure is applicable to any embodiment described. The sunshade device includes a canopy, a folding gazebo, a camping tent, and similar items. With collapsible structures in this invention, sunshade devices become structurally simple, lightweight, and do not require assembly, making them more efficient for use in the field. And the structure is stable and can be easily set up or taken down by a single individual.

Embodiment V (not Shown in Figures)

This embodiment presents an additional application of collapsible structures, specifically for use in portable hanging devices designed for drying purposes. The hanging device utilizes one of the collapsible structures described in any of the embodiments.

Embodiment VI (not Shown in Figures)

This embodiment is an additional application of the collapsible structure, which can be utilized in a folding traffic barrier. The folding traffic barrier includes one of the collapsible structures described in any of the embodiments. The folding traffic barrier can be rapidly deployed in the event of an abnormality or traffic control on the road, thus saving time.

Embodiment VII (not Shown in Figures)

This embodiment presents an alternative use of the collapsible structure, which is a display device. The display device incorporates the collapsible structure as described in any of the embodiments, resulting in a swift and highly stable setup. Removal of the display is also quick and effortless. It's lightweight, making it easy to carry and transport to various locations. The device is functional for displaying warning signs, advertisements, and road signs, among other uses.

Embodiment VIII

Figure 8:
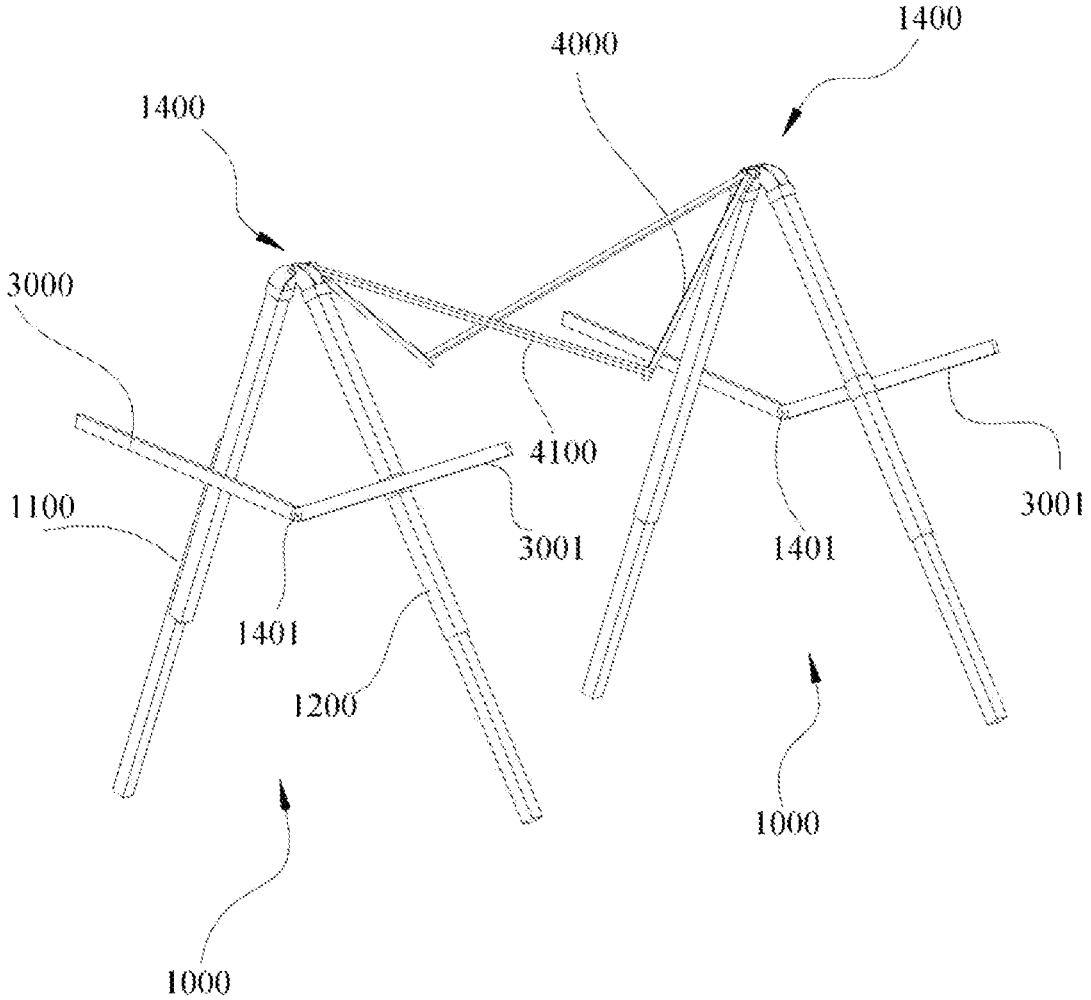
FIG. 8 shows a schematic view of embodiment XIII.

As shown in FIG. 8, the embodiment discloses a collapsible structure comprising at least two standing frames 1000, each including two standing poles: a first standing pole 1100 and a second standing pole 1200. The two standing poles pivotally connected at top via a first pivot point 1400. The first standing pole 1100 and the second standing pole 1200 are pivotally connected with the first bracing pole 3000 and the second bracing pole 3001, respectively. The first bracing pole 3000 and the second bracing pole 3001 are pivotally connected at their inner ends through the second pivot point 1401.

This embodiment includes two standing frames 1000, but in other embodiments, the quantity may vary depending on the required length of the structure. It can be 3, 4, 5, etc. The pivotal connection or pivot point of this embodiment may be a hinge, rotating knuckle, spindle, rotation shaft, universal joints, or similar mechanisms.

In this embodiment, the first pivot point 1400 is a connecting member with four connecting ends, and the second pivot point 1401 is a connecting member with two connecting ends. The connecting member can be an articulated joint or a connecting hub with at least one pivot axis. For example, in the case of the first pivot point 1400, its four connecting ends are pivotally connected to the upper ends of the first standing pole 1100, the second standing pole 1200, and the two extendable link assemblies 4100 respectively. In other embodiments, the connecting member may have more connecting ends corresponding to the number of poles connected to it.

Specifically, in this embodiment, when the first standing pole 1100 rotates relative to the second standing pole 1200 to be folded or unfolded, the first bracing pole 3000 and the second bracing pole 3001 rotate accordingly through the second pivot point 1401. As the second pivot point 1401 moves away from or close to the first pivot point 1400, the first standing pole 1100 and the second standing pole 1200 fold or unfold.

In this embodiment, an extendable linkage 4000 is provided between the two adjacent standing frames 1000 to enable them to move closer or further apart. The extendable linkage 4000 is a mechanism that links the two adjacent standing frames 1000 and can adjust the distance between them.

In this embodiment, the extendable linkage 4000 includes at least one extendable link assembly 4100. Each extendable link assembly 4100 has two sections with a pivot joint connecting them in the middle, allowing them to be folded or unfolded. Once the extendable link assembly 4100 is extended, the pivot joint can be locked. Each end of the extendable link assembly 4100 is connected to the first pivot points 1400 of two adjacent standing frames 1000. The extendable assembly can lock the joints when extended. The pivotal connections or joints in this embodiment may include hinges, pivotal knuckles, pivot axes, rotating shafts, and similar components.

Additionally, to enhance the structural stability of the collapsible structure and increase wind resistance, this embodiment includes two extendable link assemblies 4100 located on either side of the standing frames 1000.

In this embodiment, the outer ends of the first bracing pole 3000 and the second bracing pole 3001 extend outwardly and out of the standing frame 1000 to form a connection portion for the canvas. Both the first bracing pole 3000 and the second bracing pole 3001 have outer ends available for connecting the canvas, tarpaulin, etc. Thus, the canvas or tarpaulin attached to the top of the structure folds and unfolds following the movement of the collapsible structure. In addition, by attaching the canvas from the top of the structure downward to the connecting portion extending from the first bracing pole 3000 and second bracing pole 3001, the shade coverage is increased.

In this embodiment, each first standing pole 1100, second standing pole 1200, first bracing pole 3000, and second bracing pole 3001 of the standing frame 1000 is equipped with n axially retractable telescoping tubes. This allows the standing frame 1000 to be adjusted to different heights and the shade coverage to be modified as per user's requirements.

In other embodiment (not shown in this figure), a locking device is provided between the first pivot point and the second pivot point of the standing frame. This allows the second pivot point to remain in place when the structure is unfolded. A locking device may be provided on the extendable linkage to keep it in position when extended.

Specifically, the locking device may have a locking rod, a locking cable, or a turning stopper. For example, a locking rod is suspended from the center of the first pivot point 1400, and a corresponding lock has a lock hole at the second pivot point 1401. When the collapsible structure is opened, the first and second pivot points move closer to each other until the locking rod is inserted into the compartment of the locker and locked. The locking mechanism could be a screw latch, spring loaded pin in the locker restricting the locking rod. The locking cable can serve the function of the locking rod with the help of certain stoppers. Some turning stoppers as other alternative locking devices, at the pivot points of standing poles and bracing poles or any other pivot points or joints of the collapsible structure, can also keep the structure in position when it is opened. Certainly, the turning stoppers are also provided on the extendable linkage 4000. The locking device is intended to keep the collapsible structure rigid and stable when it's unfolded, thus preventing accidental collapse during use for safety reasons. The locking device is a common technology in the prior art and this embodiment will not be described in detail.

Embodiment VIIII (not Shown in Figure)

In the embodiment, the collapsible structure consists of two adjacent standing frames. The upper ends of the standing frames are closer together than their lower ends. As a result, the two standing frames are angled towards each other, improving the standing stability of the collapsible structure. The other technical solutions of this embodiment are the same as those in embodiment VIII, therefore this embodiment will not be described again.

Embodiment X

Figure 9:
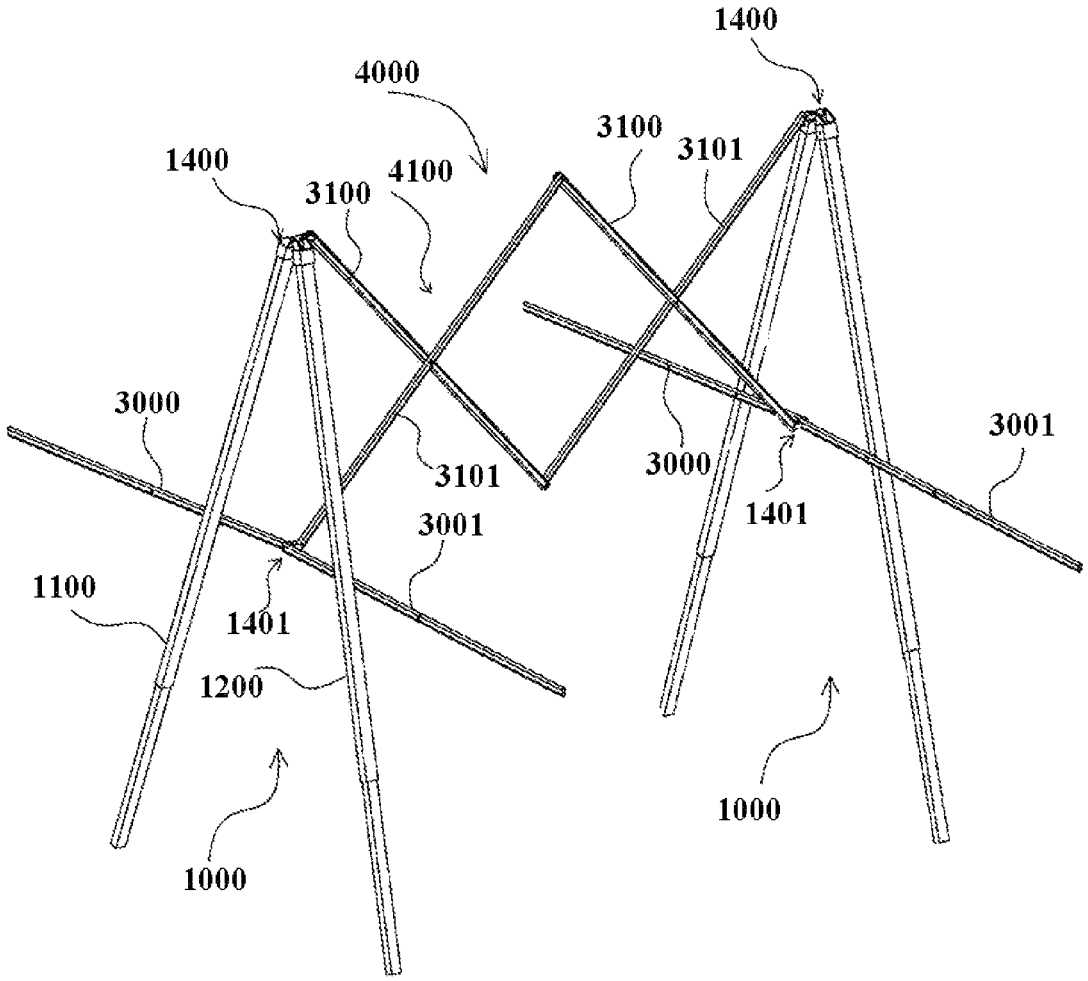
FIG. 9 shows a schematic view I of embodiment X.
Figure 10:
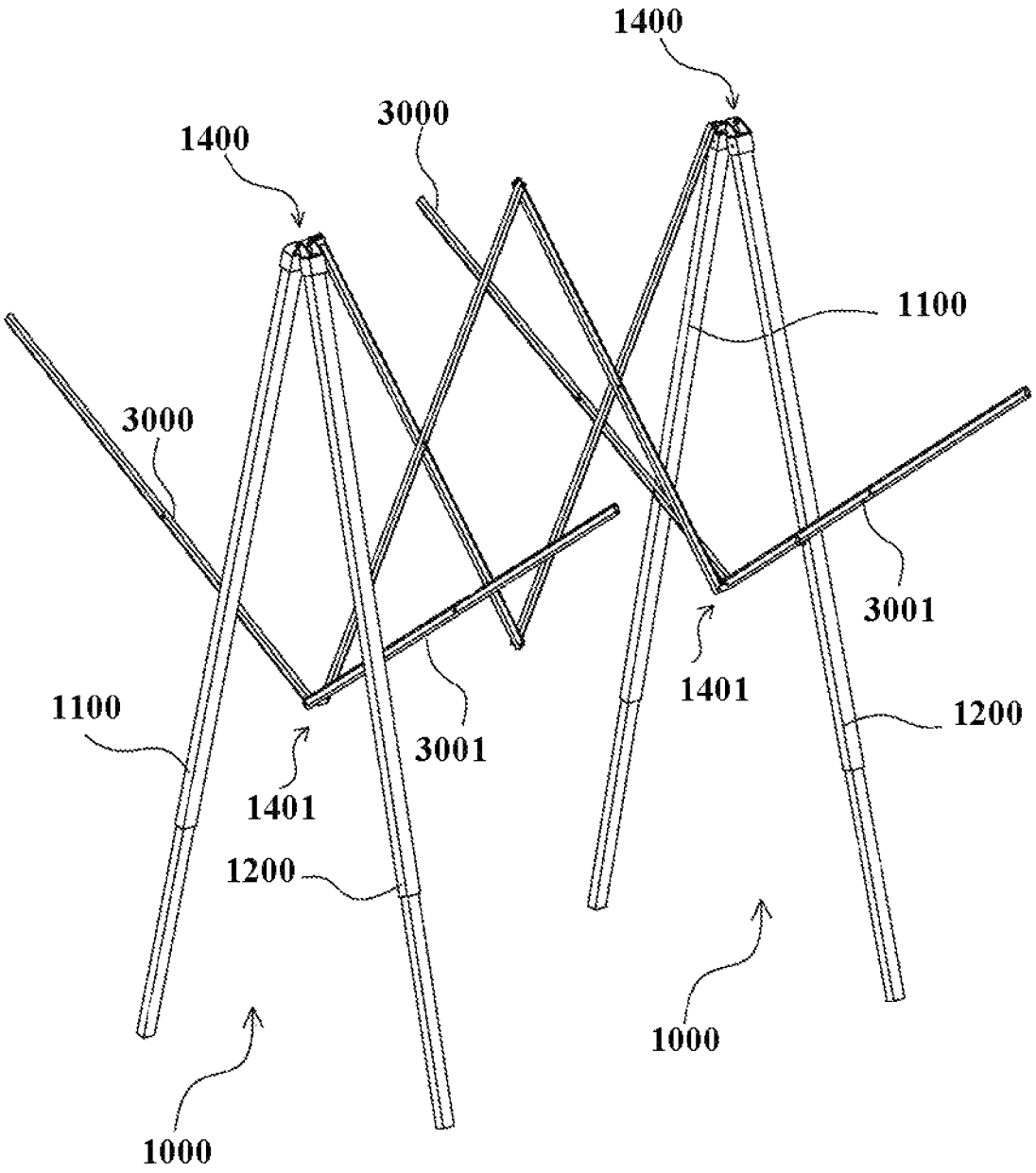
FIG. 10 shows a schematic view II of embodiment X.
Figure 11:
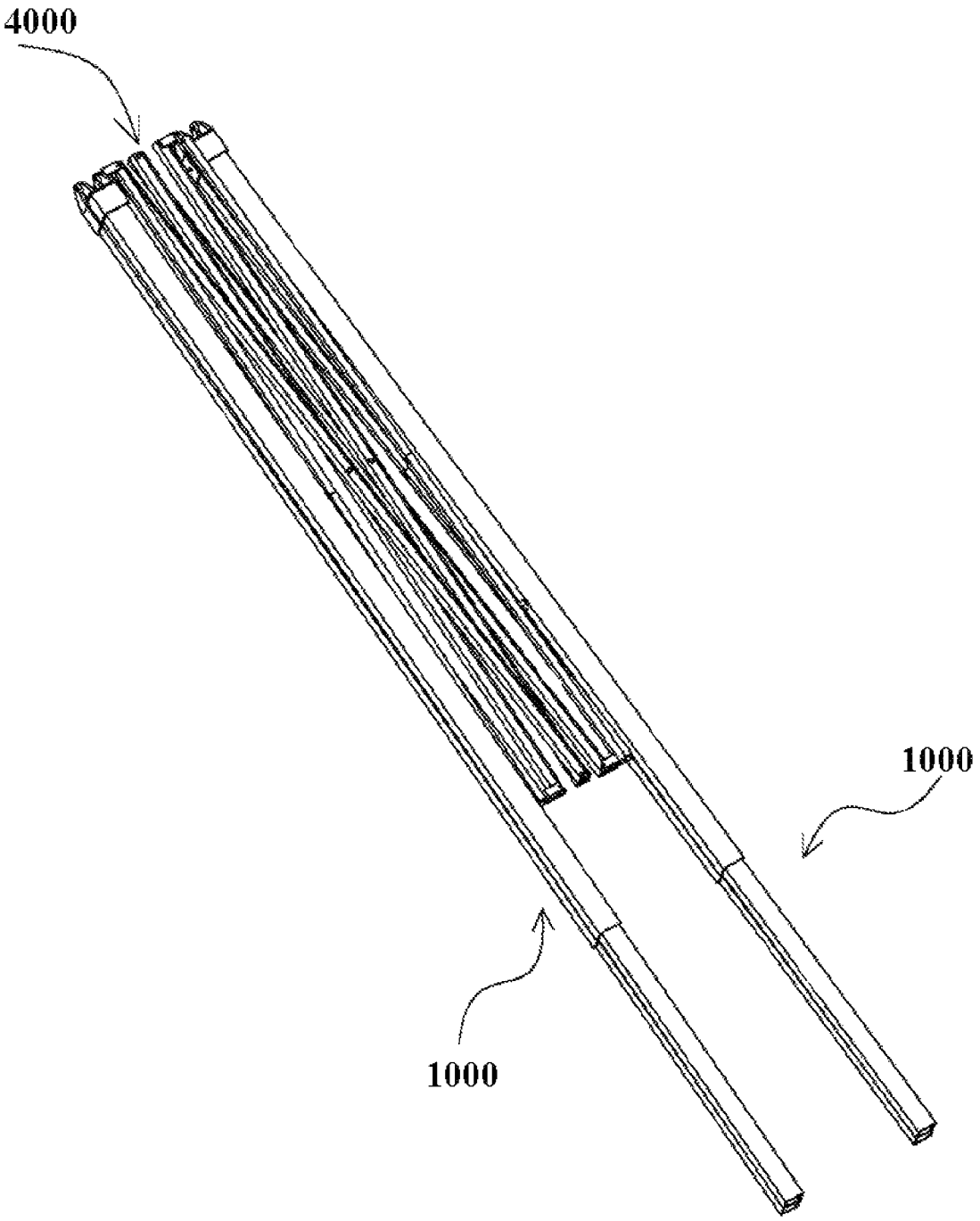
FIG. 11 shows a schematic view III of embodiment X.

As shown in FIGS. 9 to 11, it discloses a collapsible structure, wherein it comprises: at least a pair of standing frames 1000, each standing frame consisting of two standing poles: the first standing pole 1100 and the second standing pole 1200, which are pivotally connected at the top through a first pivot point 1400. The first standing pole 1100 is pivotally connected with the first bracing pole 3000, and the second standing pole 1200 is pivotally connected with the second bracing pole 3001. The inner ends of the first bracing pole 3000 and the second bracing pole 3001 are pivotally connected together through a second pivot point 1401.

In this embodiment, there are two standing frames 1000, but in other embodiments, there may be three, four, five, etc. depending on the required length of the collapsible structure. The pivotal connections in this embodiment may be hinges, rotating knuckles, spindles, rotating shafts, universal joints, or other similar components.

Wherein the first pivot point 1400 and the second pivot point 1401 in the present invention are connecting members with three connecting ends, such as articulated joints or connecting hubs, each with a pivot axis. For example, in the case of the first pivot point 1400, its three connecting ends are pivotally connected to the upper ends of the first standing pole 1100, the second standing pole 1200, and the extendable linkage 4000, respectively.

In other embodiments (not shown in this figure), the connecting member may have four connecting ends corresponding to the number of poles connected thereto. When the first standing pole 1100 rotates relative to the second standing pole 1200 to be folded or unfolded, the first bracing pole 3000 and the second bracing pole 3001 rotate accordingly through the second pivot point 1401. As the second pivot point 1401 moves away from or closer to the first pivot point 1400, the first standing pole 1100 and the second standing pole 1200 fold or unfold.

In this embodiment, an extendable linkage 4000 is provided between two adjacent standing frames 1000, allowing them to close up or extend out. The first end of the extendable linkage 4000 is connected to the first pivot point 1400 and the second pivot point 1401 of one standing frame 1000, while the second end is connected to the first pivot point 1400 and the second pivot point 1401 of another standing frame 1000.

Specifically, when the extendable linkage 4000 folds, it drives the second pivot points 1401 away from the first pivot points 1400, causing the bracing poles and standing poles to rotate and fold accordingly. When the extendable linkage 4000 unfolds, it drives the second pivot points 1401 towards the first pivot points 1400, causing the bracing poles and standing poles to rotate and unfold accordingly.

As shown in FIGS. 9 to 11, in this embodiment of the collapsible structure, the first standing pole 1100 and the second standing pole 1200 of each standing frame 1000 are pivotally connected by first pivot point 1400 at the top. The first standing pole 1100 is pivotally connected with the first bracing pole 3000, and the second standing pole 1200 is pivotally connected with the second bracing pole 3001. The inner ends of the first bracing pole 3000 and the second bracing pole 3001 are pivotally connected together through a second pivot point 1401. There is a synchronous linking relationship between first standing pole 1100, second standing pole 1200, first bracing pole 3000 and second bracing pole 3001 of standing frame 1000.

In this embodiment, to extend the collapsible structure, it only needs to move the two adjacent standing frames 1000 apart, which extend the extendable linkage 4000. The two ends of the extendable linkage 4000 then drive the second pivot points 1401 towards the first pivot points 1400 of the two adjacent standing frames 1000. Consequently, the first bracing poles 3000 and the second bracing poles 3001, along with the first standing poles 1100 and the second standing poles 1200 of both standing frames 1000 rotate and unfold accordingly. The synchronized movement allows the collapsible structure to be opened in one step.

Likewise, in this embodiment, to collapse the collapsible structure, simply move the two adjacent standing frames 1000 closer to each other, which folds the extendable linkage 4000. The two ends of the extendable linkage 4000 then drive the second pivot points 1401 away from the first pivot points 1400 of two adjacent standing frames 1000. Consequently, the first bracing poles 3000, the second bracing poles 3001, the first standing poles 1100 and the second standing poles 1200 of both standing frames 1000 rotates and unfolds accordingly. This one-step closing mechanism enhance user convenience.

Furthermore, in this embodiment, when the collapsible structure is opened, it can stand stably on its own without additional ground support. This makes it versatile for various applications. Its simple and lightweight structure also ensures portability. It can be easily opened or closed by a single person, resulting in a time-saving experience. What's more, the length of this collapsible structure is adjustable and can vary according to the user's needs by altering the quantity of standing frames 1000. This flexibility allows for personal, family, or team use for a variety of purposes.

As shown in FIGS. 9 to 11, the extendable linkage 4000 of the collapsible structure comprise at least one extendable link assembly 4100. Each extendable link assembly 4100 includes at least one pair of link members connected in an X-shaped configuration through a central pivot: the first link member 3100 and the second link member 3010. The upper end of the first link member 3100 and the second link member 3101 is pivotally connected to the first pivot point 1400 of two adjacent standing frames 1000, while the lower end of the first link member 3100 and the second link member 3101 is pivotally connected to the second pivot point 1401 of the two adjacent standing frames 1000.

In this embodiment, the extendable linkage 4000 further comprises two extendable link assemblies 4100 positioned in a sequence along the extending direction. Each extendable link assembly 4100 includes at least one pair of link members connected in an X-shaped configuration through a central pivot. The upper end of the first link member 3100 in the first extendable link assembly 4100 is pivotally connected to the first pivot point 1400 of the first standing frame 1000, while the lower end of the second link member 3101 in the same assembly is pivotally connected to the second pivot point 1401 of the first standing frame 1000. The lower end of the first link member 3100 in the first extendable link assembly 4100 is pivotally coupled to the lower end of the second link member 3101 in the second extendable link assembly 4100 through a fourth pivot point. The upper end of the second link member 3101 in the first extendable link assembly 4100 is pivotally coupled to the upper end of the first link member 3100 in the second extendable link assembly 4100 through a third pivot point 1402. The lower end of the first link member 3100 in the second extendable link assembly 4100 is pivotally connected to the second pivot point 1401 of the second standing frame 1000, while the upper end of the second link member 3101 in the second extendable link assembly 4100 is pivotally connected to the first pivot point 1400 of the second standing frame 1000.

In this embodiment, when extending the extendable linkage 4000, the linking ends on either side move the second pivot points 1401 closer to the first pivot points 1400 located on two adjacent standing frames 1000. This synchronously rotates the first bracing poles 3000, the second bracing poles 3001, the first standing pole 1100, and the second standing pole 1200 accordingly, opening the collapsible structure.

Conversely, in this embodiment, when closing the extendable linkage 4000, the linking ends at each side move the second pivot points 1401 away from the first pivot points 1400 at the two adjacent standing frames 1000. Again, this synchronously rotates the first bracing poles 3000, the second bracing poles 3001, the first standing pole 1100, and the second standing pole 1200 accordingly, closing the collapsible structure. The synchronous motion facilitates one-step opening or closing of the collapsible structure.

In this embodiment, the outer ends of the first bracing pole 3000 and the second bracing pole 3001 extend outward and out of the standing frame 1000 to form connecting portions for the canvas. The canvas, tarpaulin or similar material, is attached to the outer ends of the first bracing pole 3000 and the second bracing pole 3001. When the collapsible structure folds or unfolds, the canvas attached follows to be folding or unfolding. Furthermore, by installing the canvas from the top of the framework downward to the connecting portion extended from the first bracing pole 3000 and second bracing pole 3001, the shade coverage are augmented.

In this embodiment, each first standing pole 1100, second standing pole 1200, first bracing pole 3000, and second bracing pole 3001 of standing frame 1000 are equipped with axially retractable telescoping tubes. This allows the standing frame 1000 to be adjusted to different heights and the shading coverage to be modified too per user requirements.

In this embodiment (not shown in this figure), a locking device 3300 is provided between the first pivot point 1400 and the second pivot point 1401 of the standing frame 1000. This enables the second pivot point 1401 to remain in place when the structure is unfolded. Alternatively, a locking device 3300 can be present on the extendable linkage 4000 to keep it in position when extended.

Wherein the locking device 3300 may have a locking rod, a locking cable, or a turning stopper. For example, a locking rod is suspended from the center of the first pivot point 1400, and corresponding lock having a lock hole on the second pivot point 1401. When the collapsible structure is opened, the first and second pivot points move closer to each other until the locking rod is inserted into the hole of the locker and locked. The locking mechanism could be a latch, a spring loaded pin in the locker restricting the locking rod. The locking cable can serve the function of the locking rod with the help of certain stoppers. These locking devices 3300 could also be provided on the extendable linkages 4000 too. Certainly, some turning stoppers at the pivot points of standing poles and bracing poles or any other pivot points or joints of the collapsible structure can also keep the structure in position too when opened as other alternative locking devices.

The locking device is intended to keep the collapsible structure rigid and stable when it's unfolded, thus preventing accidental collapsing during use for safety reasons. The locking device is a common technology in the prior art and this embodiment is not described in detail.

Embodiment XI

Figure 12:
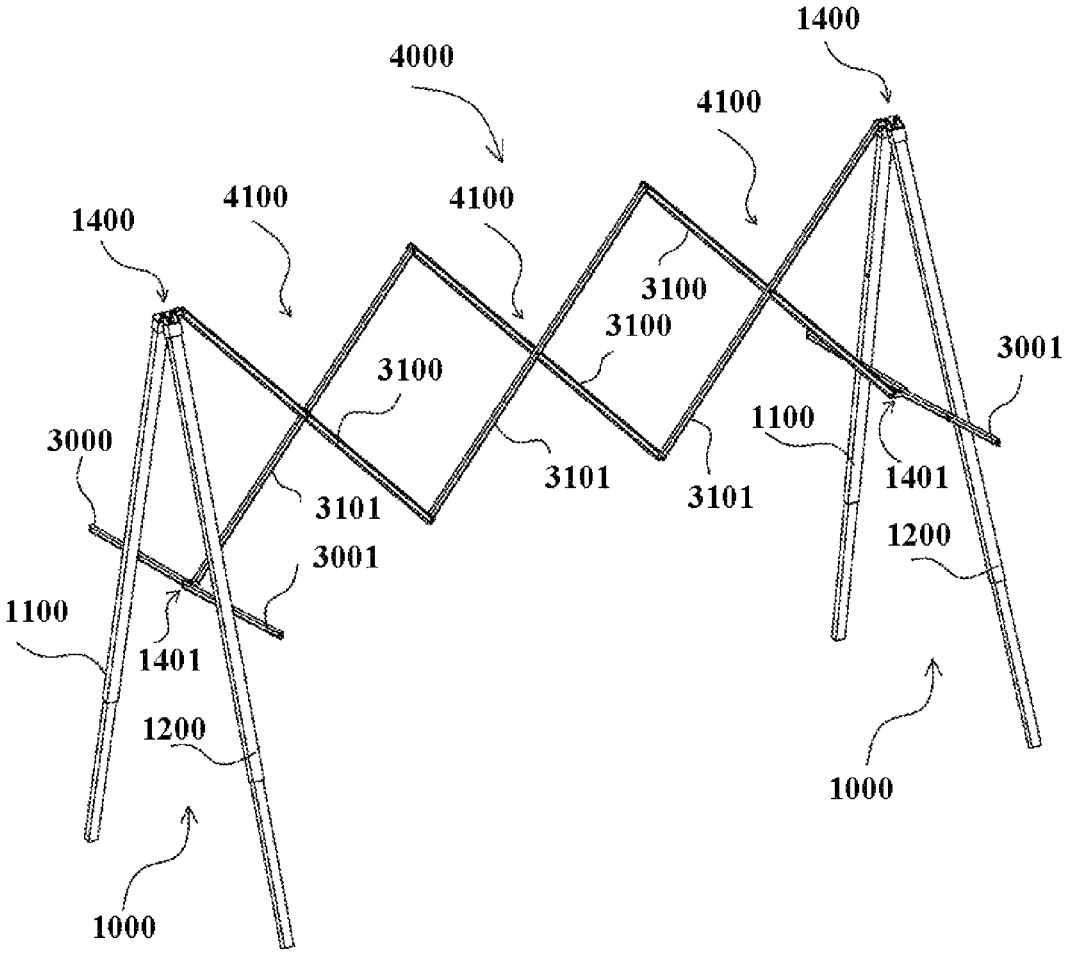
FIG. 12 shows a schematic view of embodiment XI.

As shown in FIGS. 12, the extendable linkage 4000 further comprises three extendable link assemblies 4100 positioned in a sequence along the extending direction.

Specifically, each extendable link assembly 4100 includes at least one pair of link members connected in an X-shaped configuration through a central pivot. The upper end of the first link member 3100 in the first extendable link assembly 4100 is pivotally connected to the first pivot point 1400 of the first standing frame 1000, while the lower end of the second link member 3101 in the same assembly is pivotally connected to the second pivot point 1401 of the first standing frame 1000. The lower end of the first link member 3100 in the first extendable link assembly 4100 is pivotally coupled to the lower end of the second link member 3101 in the second extendable link assembly 4100. The upper end of the second link member 3101 in the first extendable link assembly 4100 is pivotally coupled to the upper end of the first link member 3100 in the second extendable link assembly 4100. The lower end of the first link member 3100 in the second extendable link assembly 4100 is pivotally coupled to the lower end of the second link member 3101 in the third extendable link assembly 4100, while the upper end of the second link member 3101 in the second extendable link assembly 4100 is pivotally coupled to the upper end of the first link member 3100 in the third extendable link assembly 4100. The lower end of the first link member 3100 in the third extendable link assembly 4100 is pivotally connected to the second pivot point 1401 of the second standing frame 1000, while the upper end of the second link member 3101 in the third extendable link assembly 4100 is pivotally connected to the first pivot point 1400 of the second standing frame 1000. Therefore, the quantity of extendable link assembly 4100 can be set as per user's requirement. The extendable linkage 4000 can also include four, five or more extendable link assemblies 4100. The specific linking method can refer to this embodiment.

Embodiment XII

Figure 13:
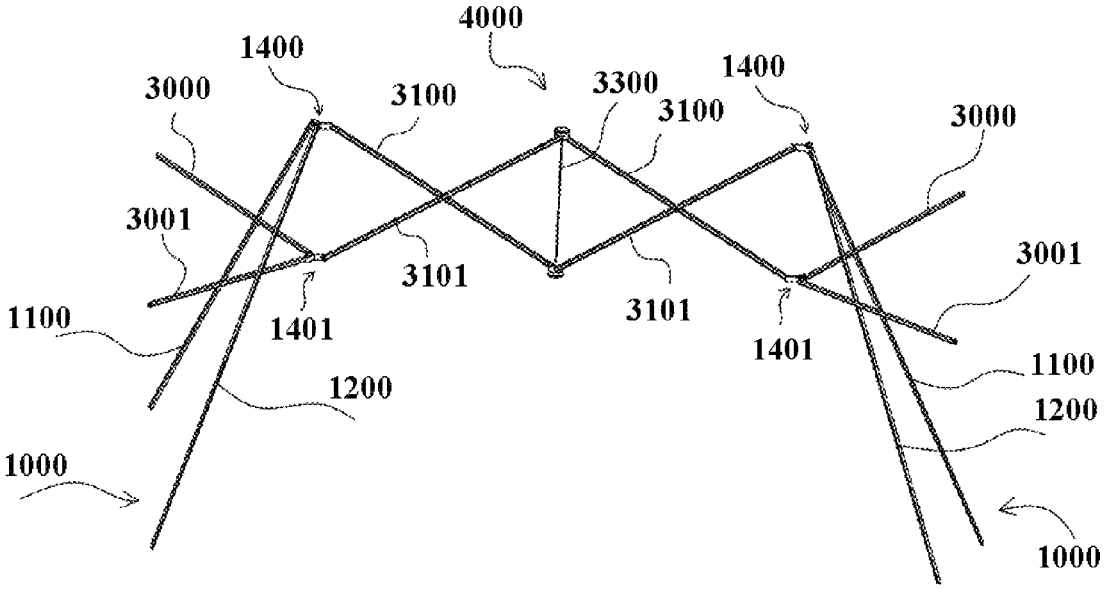
FIG. 13 shows a schematic view I of embodiment XII.
Figure 14:
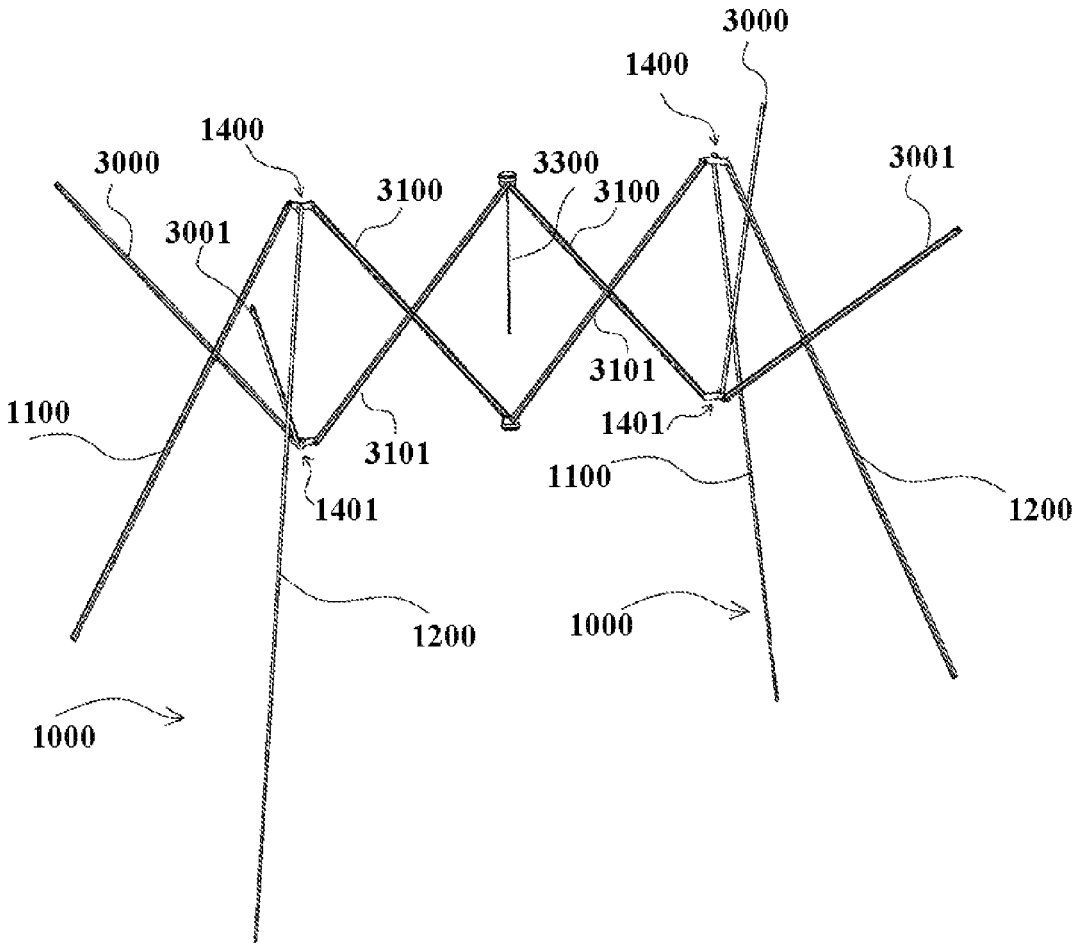
FIG. 14 shows a schematic view II of embodiment XII.

As shown in FIGS. 13 to 14, in the embodiment, the collapsible structure consists of two adjacent standing frames 1000. The upper ends of the standing frames 1000 are closer together than their lower ends. Additionally, each standing frame 1000 has a first pivot point 1400 and second pivot point 1401 which are vertically aligned.

As a result, the two standing frames 1000 are angled to each other, promoting the standing stability of the collapsible structure. In addition, because the first bracing poles 3000 and second bracing poles 3001 extend at an angle from the standing frames 1000, the corners of canvas or tarp are attached to the tip points of bracing poles at angle. This increases the stability and wind resistance of a canopy by providing better bracing at the corners due to a more even distribution of stress more evenly at each corner.

Additionally, in this embodiment, a locking device 3300 is provided on the extendable linkage 4000 to lock it in position when it is extended. Consequently, the entire collapsible structure is locked in position. The locking device may also be provided between the first pivot points 1400 and the second pivot points 1401 of the standing frames 1000, locking the second pivot point 1401 in position when the frame is unfolded. The locking device has been described in another embodiment and will therefore not be repeated in detail. The other technical solutions of this embodiment are the same as the embodiment X, so this embodiment will not be described again.

Example XIII

Figure 15:
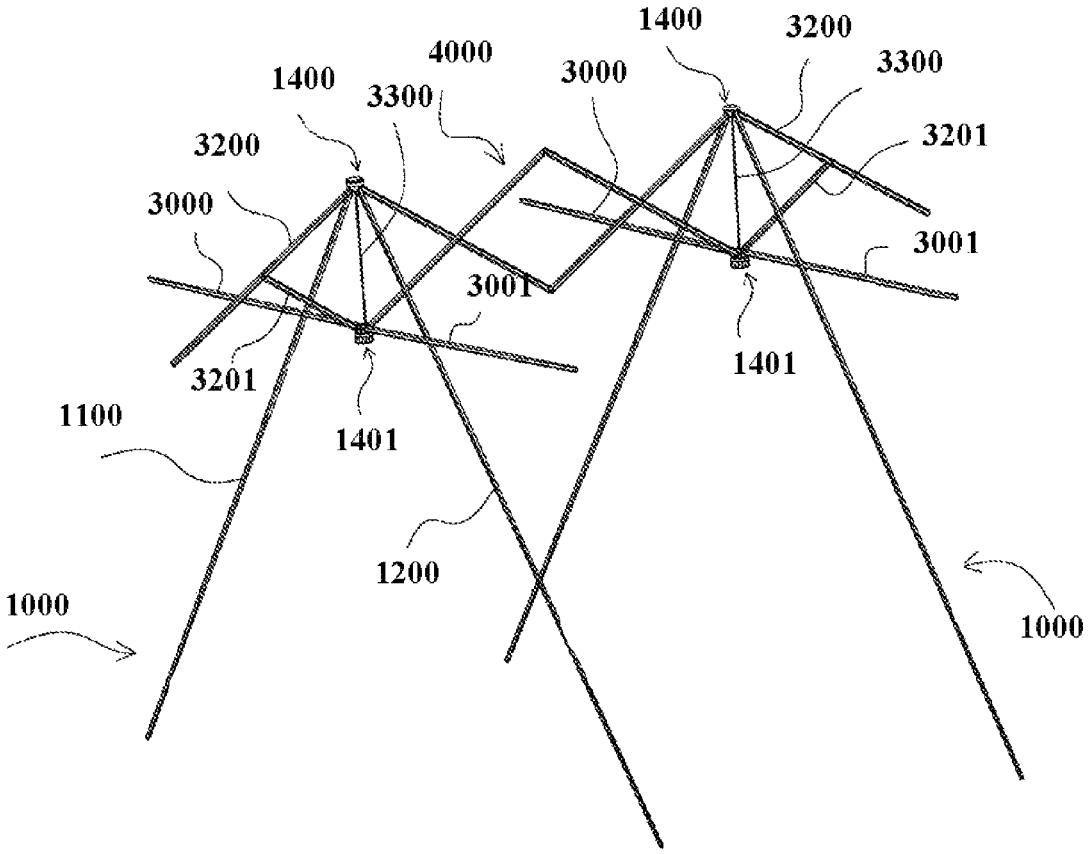
FIG. 15 shows a schematic view I of embodiment XIII.
Figure 16:
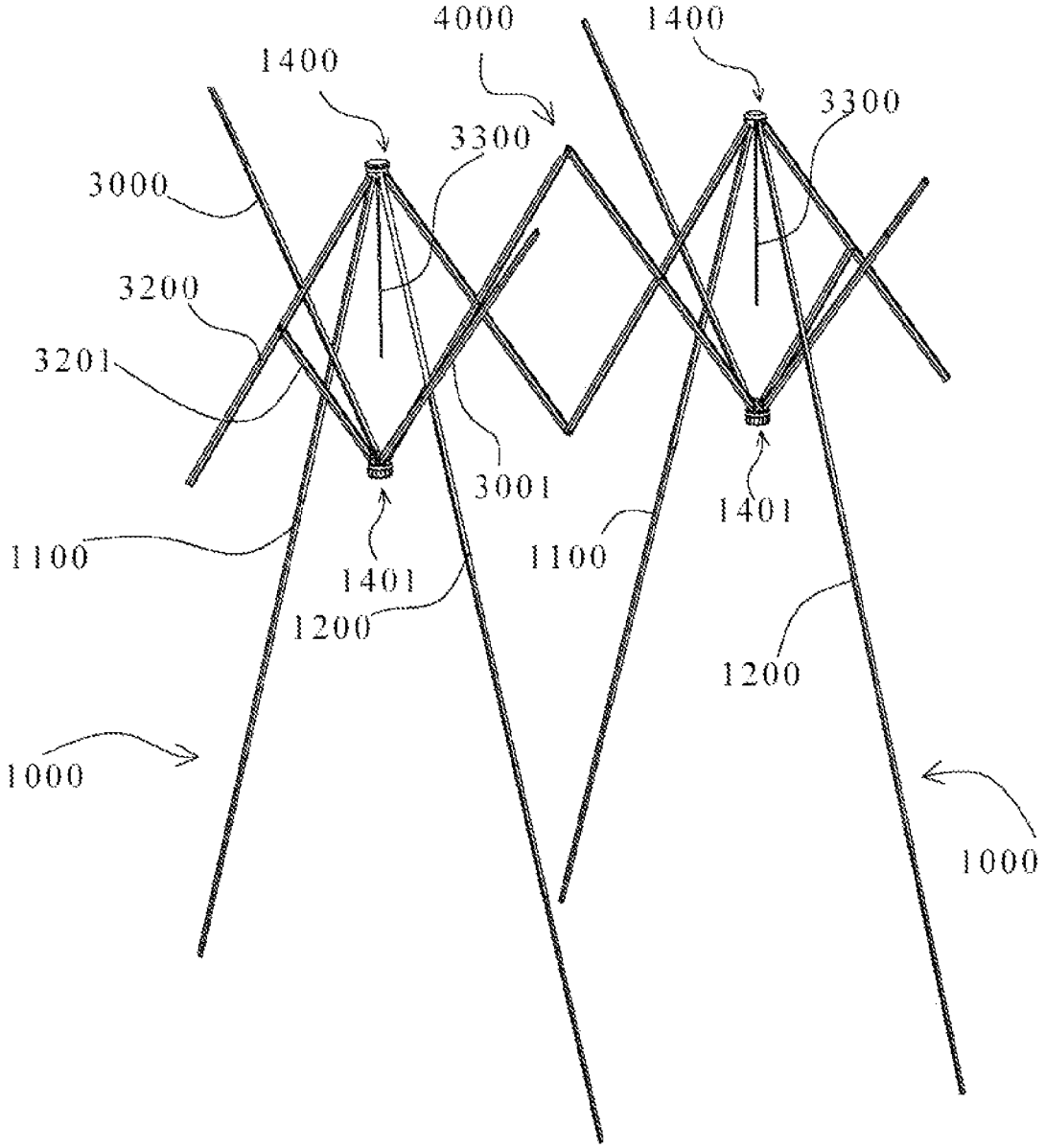
FIG. 16 shows a schematic view II of embodiment XIII.

As shown in FIGS. 15 to 16, in the embodiment, the collapsible structure comprises two standing frames 1000. The standing frames 1000 have the first pivot points 1400 and second pivot points 1401 that are vertically aligned.

Specifically, each standing frame 1000 further include a side extension pole 3200 and a side bracing pole 3201 attached to its outer side. The upper end of the side extension pole 3200 pivots to the first pivot point 1400 of the standing frame 1000, while one end of the side bracing pole 3201 pivots to the second pivot point 1401 of the standing frame 1000, and the other end of the side bracing pole 3201 pivots to the side extension pole 3200.

In this embodiment, the two sides extension poles 3200 of the standing frames 1000 enlarge the top coverage of the collapsible structure once it is opened. Thus, the shade coverage by the canvas attached to the collapsible structure is correspondingly increased. The extra poles help secure the canvas too. As the side extension pole 3200 is pivoted to the first pivot point 1400 and the side bracing pole 3201 is pivoted to the second pivot point 1401, they rotate as the two pivot points move closer or farther apart, causing the side extension pole 3200 to unfold or fold accordingly. As a result, it folds or unfolds as the standing frame 1000 folds or unfolds. Other technical solutions of the present embodiment are the same as the embodiment X described above, so that the present embodiment does not repeat the description.

Additionally, in this embodiment, a locking device 3300 is provided between the first pivot point 1400 and the second pivot point 1401 of each standing frame 1000, which locks the second pivot point in position when the frame is unfolded. The locking device may also be provided on the extendable linkage 4000 to lock it in position. The locking device has been described in other embodiment and will there not be repeated in detail.

Embodiment XIIII

Figure 17:
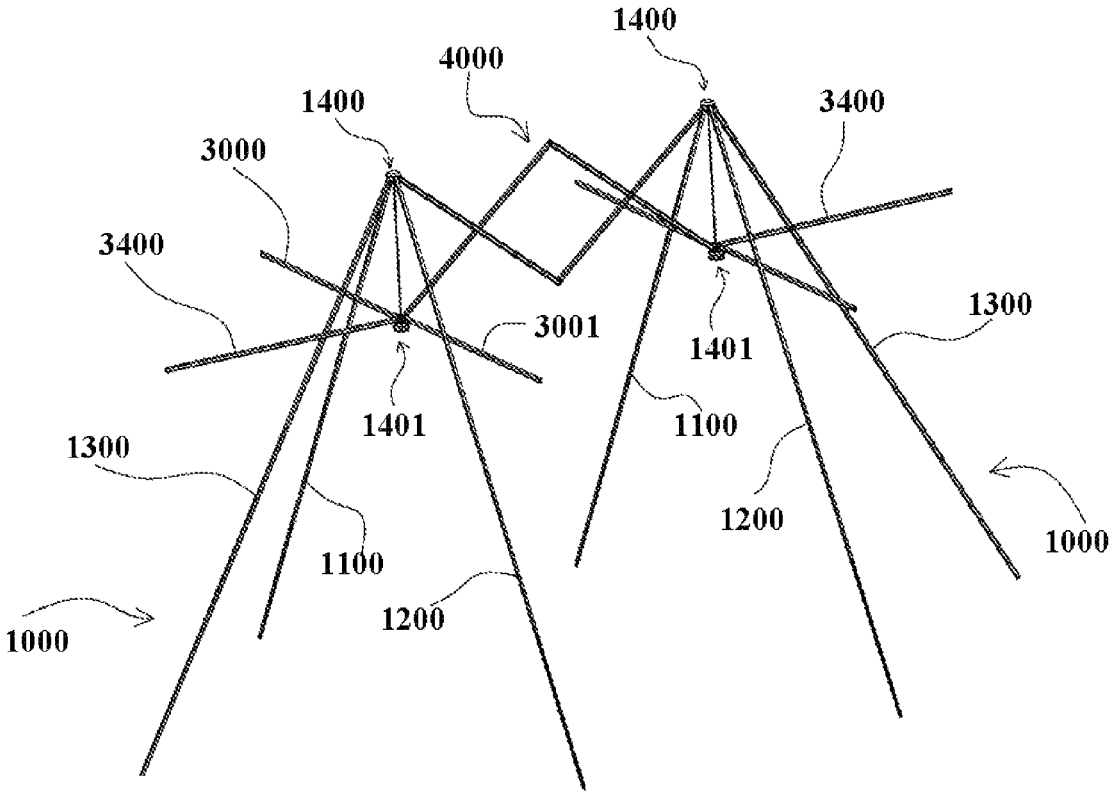
FIG. 17 shows a schematic view I of embodiment XIIII.
Figure 18:
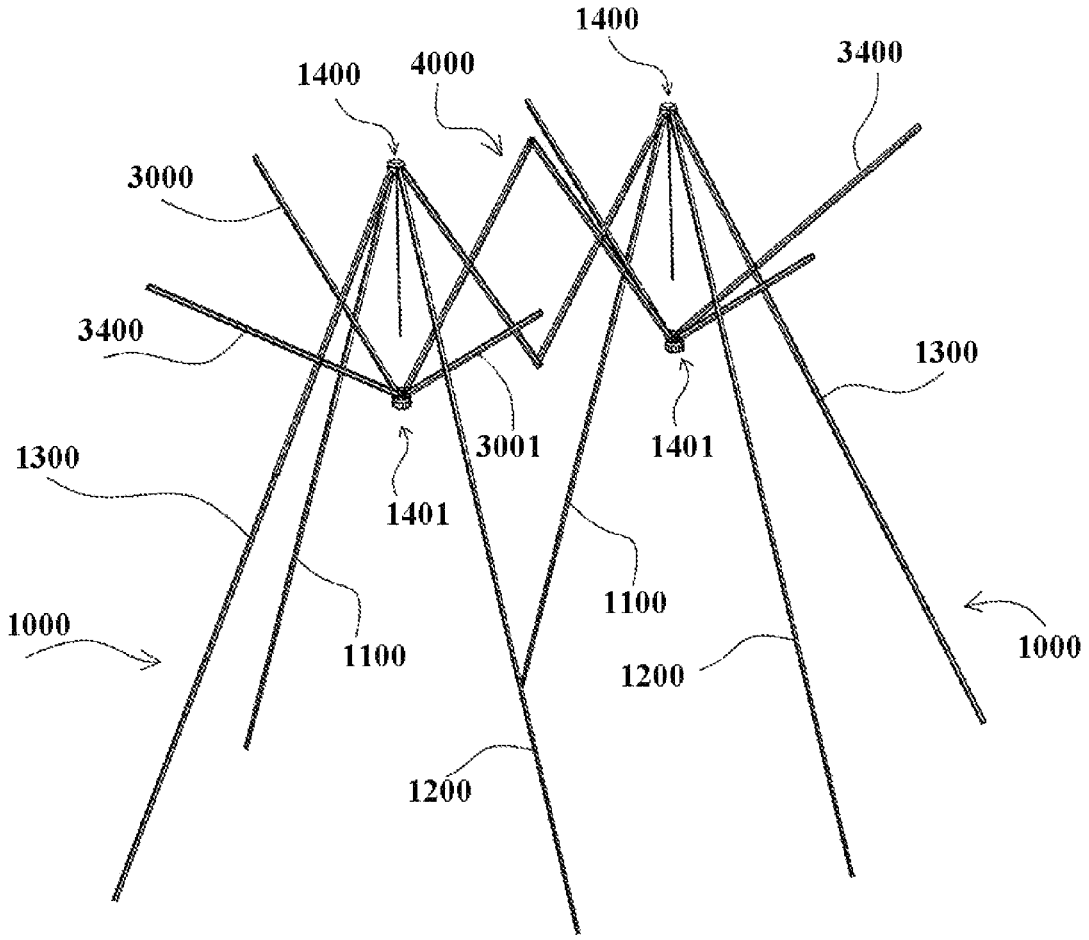
FIG. 18 shows a schematic view II of embodiment XIIII.

As shown in FIGS. 17 to 18, in the embodiment, the collapsible structure comprises two standing frames 1000. The first pivot point 1400 and second pivot point 1401 of each standing frame 1000 are vertically aligned.

Specifically, each standing frame 1000 also has a third standing pole 1300 and a third bracing pole 3400 located on the outer side. The upper end of the third standing pole 1300 connects pivotally to the first pivot point 1400 of the standing frame 1000, while the lower end is level with the first standing pole 1100 and the second standing pole 1200. One end of the third bracing pole 3400 connects pivotally to the second pivot point 1401 of the standing frame 1000, and the other end connects pivotally to the third standing pole 1300. Thus the first standing pole 1100, the second standing pole 1200, and third standing pole 1300 are able to fold or unfold synchronously.

In this embodiment, each standing frame 1000 now actually has three standing poles, forming a tripod that provides additional stability that further enhances the wind resistance.

Additionally, in this embodiment, a locking device is provided between the first pivot point 1400 and the second pivot point 1401 of the standing frame 1000, locking the second pivot point 1401 in position when the frame is unfolded. The locking device may also be provided on the extendable linkage 4000 to lock it position when it is extended. The locking device has been described in another embodiment and will therefore not be repeated in detail. The other technical solutions of this embodiment are the same as in the above embodiment X, so that this embodiment will not repeat the description.

Embodiment XV

Figure 19:
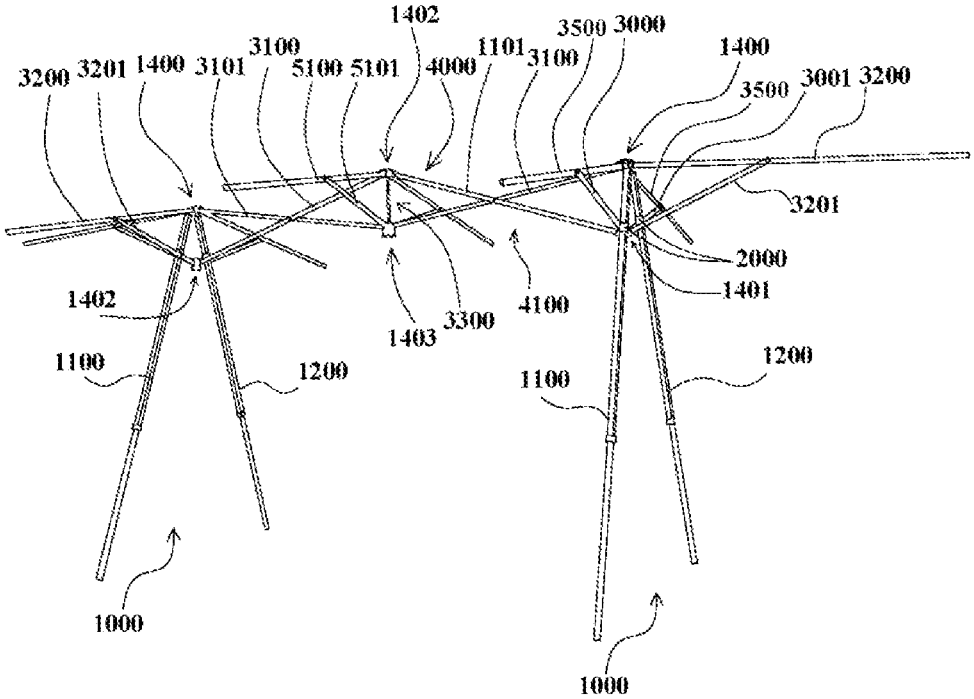
FIG. 19 shows a schematic view of embodiment XV.
Figure 19:
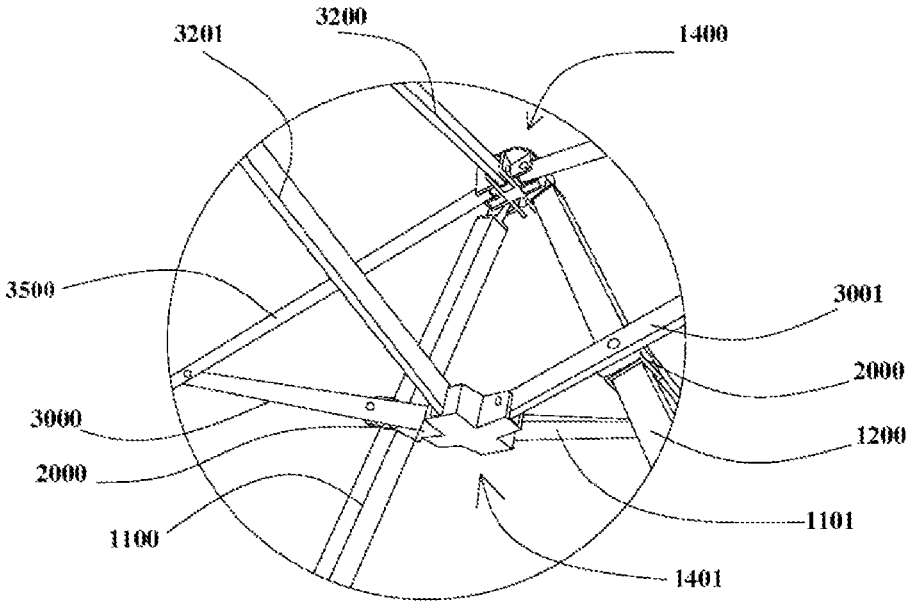

As shown in FIGS. 19, it discloses a collapsible structure, wherein it comprises: at least a pair of standing frames 1000, each standing frame consisting of two standing poles: the first standing pole 1100 and the second standing pole 1200, which are pivotally connected at the top through a first pivot point 1400. Wherein the first standing pole 1100 and the second standing pole 1200 of each standing frame 1000 further include sliding members 2000 that can slide along them. The standing frame 1000 also includes first bracing pole 3000 and second bracing pole 3001, which are pivotally connected to the sliding members 2000 on the first standing pole 1100 and second standing pole 1200, respectively. The inner ends of the first bracing pole 3000 and the second bracing pole 3001 are pivotally connected together through a second pivot point 1401.

In this embodiment, the first standing pole 1100 and the second standing pole 1200 are all equipped with axially telescoping tubes with a locking latch or cam lock to maintain the extended position between the inner and outer tubes.

In this embodiment, the sliding member 2000 described in this embodiment is a sliding sleeve mounted on the first standing pole 1100 and the second standing pole 1200. In other embodiments, a sliding channel may be provided along the first standing pole 1100 and the second standing pole 1200. The sliding member is a slider slidably fitted in the sliding channel.

The pivotal connections in this embodiment may be hinges, rotating knuckles, spindles, rotating shafts, universal joints, or other similar components. In the present invention, the first pivot point 1400 and the second pivot point 1401 are connecting members having six connecting ends, such as articulated joints or connecting hubs, each at least with a pivot axis. For example, in the case of the first pivot point 1400, its six connecting ends are pivotally connected to the upper ends of the first standing pole 1100 and the second standing pole 1200 at the two opposite sides, respectively.

In this embodiment, when the first standing pole 1100 rotates relative to the second standing pole 1200 to be folded or unfolded, the first bracing pole 3000 and the second bracing pole 3001 rotate accordingly through the second pivot point 1401. In this embodiment, the first pivot point 1400 and the second pivot point 1401 of each standing frame 1000 are vertically aligned. The first bracing pole 3000 and the second bracing pole 3001 obliquely upwardly and outwardly from the stand frame, providing support to the canvas in an obliquely upward direction.

In this embodiment, there are two standing frames 1000, but in other embodiments, there may be three, four, five, etc. depending on the required length of the collapsible structure.

In this embodiment, an extendable linkage 4000 is provided between two adjacent standing frames 1000, allowing them to close up or extend out. The first end of the extendable linkage 4000 is connected to the first pivot point 1400 and the second pivot point 1401 of one standing frame 1000, while the second end is connected to the first pivot point 1400 and the second pivot point 1401 of another standing frame 1000.

When two standing frames 1000 move closer to each other, the extendable linkage 4000 folds. It then drives the second pivot points 1401 and the sliding member 2000 away from the first pivot points 1400, causing the first bracing pole 3000, the second bracing pole 3001, the first standing pole 1100, and the second standing pole 1200 to rotate and fold accordingly.

Likewise, when two standing frames move away from each other, the extendable linkage 4000 unfolds. It drives the second pivot points 1401 and the sliding members 2000 toward the first pivot points 1400, causing the bracing poles and standing poles to rotate and unfold accordingly.

When the collapsible structure extends, the sliding members 2000 may bring the first bracing poles 3000 and the second bracing poles 3001 closer to the first pivot points 1400. It also causes the extendable linkage 4000 to extend further outwardly, pushing two adjacent standing frames 1000 further apart. This further increases the height of the bracing poles, and in the meantime increases the distance between two standing frames 1000. As a result, the clearance height of canvas attached to the top frame is greater and shade coverage is larger.

In this invention, the clearance height refers to the distance between the edge of the canvas and the ground. When the collapsible structure is unfolded, the greater the distance between the edge of the canvas to the ground is, the greater the clearance height, and vice versa.

In this embodiment, each standing frame 1000 includes the first standing pole 1100 and the second standing pole 1200, the outer end of which extend out of the standing frame 1000 and form a connecting portion for attaching canvas.

Particularly, as shown in FIG. 19, in this embodiment, each standing frame 1000 also includes two pull poles 3500 corresponding to the first bracing pole 3000 and the second bracing poles 3001. The upper ends of two pull poles 3500 are pivotally connected to the first pivot point 1400, and two pull poles 3500 are also pivotally connected to the first bracing pole 3000 and the second bracing pole 3001, respectively.

Through these pivot points, the two pull poles 3500 are in synchronous motion with the first bracing poles 3000 and the second bracing poles 3001, and further with the first standing poles 1100, the second standing poles 1200, and the extendable linkage 4000. They fold and unfold as the entire collapsible structure folds and unfolds.

In this embodiment, the connecting portions of the first bracing poles 3000 and the second bracing poles 3001 are available for canvas or tarp attachment. The canvas folds or unfolds as the collapsible structure folds or unfolds. With the pull poles 3500 included, it not only further increases the stability and security of the standing frame 1000, it also provides additional support for the canvas that can be attached to the pull poles 3500 and additional shade coverage with the outer ends of the pull poles 3500 usually extending further out from the bracing poles.

As shown in FIG. 19, in the embodiment, each standing frame 1000 also includes a side extension pole 3200 and a side bracing pole 3201 attached to its outer side. The upper end of the side extension pole 3200 pivots to the first pivot point 1400 of the standing frame 1000, while one end of the side bracing pole 3201 pivots to the second pivot point 1401 of the standing frame 1000, and the other end of the side bracing pole 3201 pivots to the side extension pole 3200. As the side extension pole 3200 is connected to the first pivot point 1400 and the side bracing pole 3201 is connected to the second pivot point 1401, they rotate as the two pivot points move closer or farther apart, causing the side extension pole 3200 to unfold or fold accordingly. As a result, it folds or unfolds as the standing frame 1000 folds or unfolds. The two sides extension poles 3200 of the standing frames 1000 enlarge the top coverage of the collapsible structure once it is opened. Thus, the shade coverage by the canvas attached to the collapsible structure is correspondingly increased. The extra poles also help secure the canvas.

As shown in FIG. 19, in the embodiment, the extendable linkage 4000 comprises at least two extendable link assemblies 4100 positioned in a sequence along the extending direction. Each extendable link assembly 4100 includes at least one pair of link members connected in an X-shaped configuration through a central pivot.

In this embodiment, the upper end of the first link member 3100 in the first extendable link assembly 4100 is pivotally connected to the first pivot point 1400 of the first standing frame 1000, while the lower end of the second link member 3101 in the same assembly is pivotally connected to the second pivot point 1401 of the first standing frame 1000. The lower end of the first link member 3100 in the first extendable link assembly 4100 is pivotally coupled to the lower end of the second link member 3101 in the second extendable link assembly 4100 through a fourth pivot point 1403. The upper end of the second link member 3101 in the first extendable link assembly 4100 is pivotally coupled to the upper end of the first link member 3100 in the second extendable link assembly 4100 through a third pivot point 1402. The lower end of the first link member 3100 in the second extendable link assembly 4100 is pivotally connected to the second pivot point 1401 of the second standing frame 1000, while the upper end of the second link member 3101 in the second extendable link assembly 4100 is pivotally connected to the first pivot point 1400 of the second standing frame 1000.

In this embodiment, when extending the extendable linkage 4000, the linking ends on either side move the second pivot points 1401 closer to the first pivot points 1400 located on two adjacent standing frames 1000. The third pivot point 1402 also move closer to the fourth pivot point 1403 at the same time. The movement synchronously rotates the first bracing poles 3000, the second bracing poles 3001, the first standing pole 1100, the second standing pole 1200, and the other linked poles as a whole, thereby opening the collapsible structure.

Conversely, when closing the extendable linkage 4000, the linking ends at each side move the second pivot points 1401 away from the first pivot points 1400 at the two adjacent standing frames 1000. The third pivot point 1402 also moves away from the fourth pivot point 1403 at the same time. Again, the movement synchronously rotates the first bracing poles 3000, the second bracing poles 3001, the first standing pole 1100, the second standing pole 1200, and the other linked poles as a whole, thereby closing the collapsible structure. The synchronous motion facilitates one-step opening or closing of the collapsible structure.

As shown in FIG. 19, in the embodiment, the extendable linkage 4000 is pivotally connected with a first support pole 5100 and a second support pole 5101 on each side. The first support pole 5100 is connected to the third pivot point 1402, while the second support pole 5101 is connected to the fourth pivot point 1403. The other end of the second support pole 5101 is connected to the first support pole 5100.

Specifically, the first support pole 5100 and the second support pole 5101 are able to fold and unfold as the collapsible structure folds and unfold due to the synchronous motion drives by the third pivot point 1402 and the fourth pivot point 1403. Thus, there is no change in the one-step folding or unfolding of the collapsible structure. The mechanism is the same as other similar synchronous motion structure described elsewhere in this invention. The first support pole 5100 is for supporting the canvas attached thereto to prevent sagging in the center of the shade canopy.

As shown in FIG. 19, in this embodiment, a locking device 3300 is provided between the first pivot point 1400 and the second pivot point 1401 of the standing frame 1000, or between the third pivot point 1402 and the fourth pivot point 1403 of the extendable linkage 4000. This allows the collapsible structure to be locked once it is extended.

In this embodiment, the locking device 3300 may have a locking rod, a locking cable, or a turning stopper. For example, a locking rod is suspended from the center of the first pivot point 1400, and a corresponding lock has a locking hole on the second pivot point 1401. When the collapsible structure is opened, the first and second pivot points move closer to each other until the locking rod is inserted into the hole of the locker and locked. The locking mechanism could be a latch, a spring loaded pin in the compartment that restricts the locking rod. The locking cable can serve the function of the locking rod with the help of certain stoppers. These locking devices 3300 could also be provided on the extendable linkages 4000. Certainly, some turning stoppers at the pivot points of standing poles and bracing poles or any other pivot points or joints of the collapsible structure can also keep the structure in position too when opened as other alternative locking devices. The locking device is intended to keep the collapsible structure rigid and stable when it's unfolded, thus preventing accidental collapse during use for safety reasons. The locking device is a common technology in the prior art and this embodiment is not described in detail.

When the collapsible structure is extended, in this embodiment, it is self-standing with excellent stability without needing to be fixed to the ground or require a specific installation site, making it versatile for a wide range of uses. When folding or unfolding the collapsible structure, it is especially easy due to its synchronous motion mechanism. One person can effortlessly extend the collapsible structure. The structure is simple and compact once it's collapsed. It's lightweight and portable, making it easy to use, labor-saving, and user-friendly. Additionally, the A-shaped standing frame provide the special stability helps to withstand wind better. Furthermore, the number of standing frames 1000 can be increased as required, making the length of the collapsible structure adaptable and flexible in size for personal, family or team use.

Embodiment XVI

Figure 20:
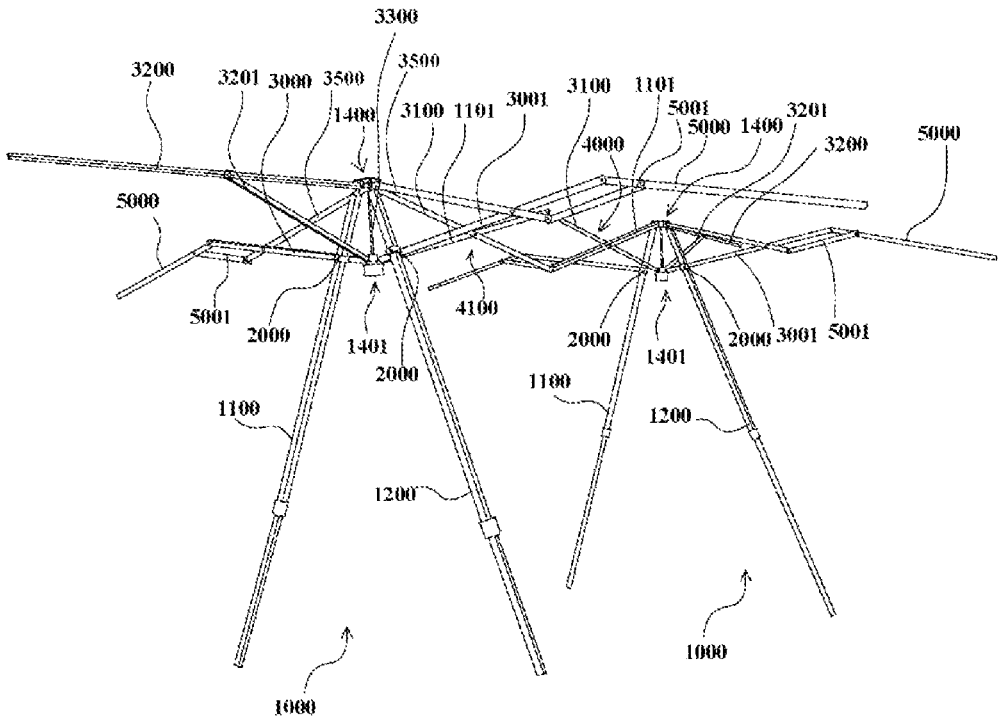
FIG. 20 shows a schematic view of embodiment XVI.
Figure 20:
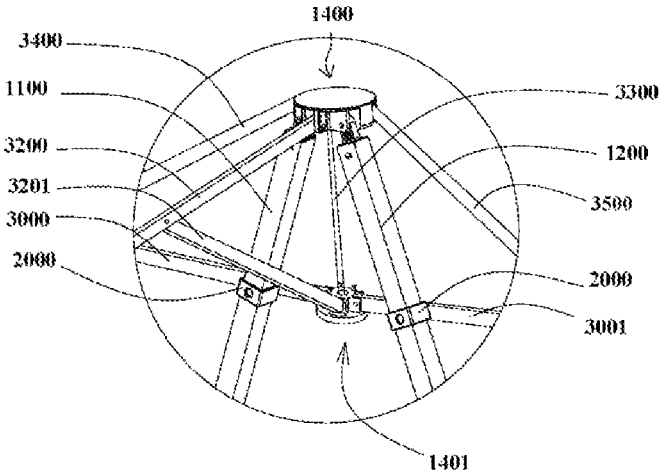

As shown in FIG. 20, in this embodiment, each standing frame 1000 includes two pull poles 3500 corresponding to the first bracing pole 3000 and the second bracing pole 3001. The upper ends of two pull poles 3500 are pivotally connected to the first pivot point 1400, and two pull poles are also pivotally connected to the first bracing pole 3000 and the second bracing pole 3001, respectively. The outer end of a bracing pole is pivotally connected to a first pole 5000 which is inclined downward. A second pole 5001 is pivotally connected between the first pole 5000 and the pull pole 3500. One end of the second pole 5001 is connected to the first pole 5000 and the other end is connected to the lower end of the pull pole. The pull pole 3500, the first bracing pole 3000 or second bracing pole 3001, the first pole 5000 and the second pole 5001 form a rectangular structure. These poles are connected for synchronous movement for folding or unfolding as the similar mechanism described elsewhere in the invention.

In this embodiment, the outer ends of the two bracing poles, the first poles 5000, are for attaching the canvas once they are extended. With this arrangement, the canvas comes from the apex of the frame all the way to the outer ends of the first poles 5000, which greatly increases the shade coverage while keeping the collapsible structure compact once it is closed.

The addition of the pull poles 3500 reinforces the standing frame 1000. It also makes it possible to connect additional poles, such as the first pole 5000 and the second pole 5001. The rest of the structure is the same as in the embodiment XV and will therefore not be repeated.

Embodiment XVII

Figure 21:
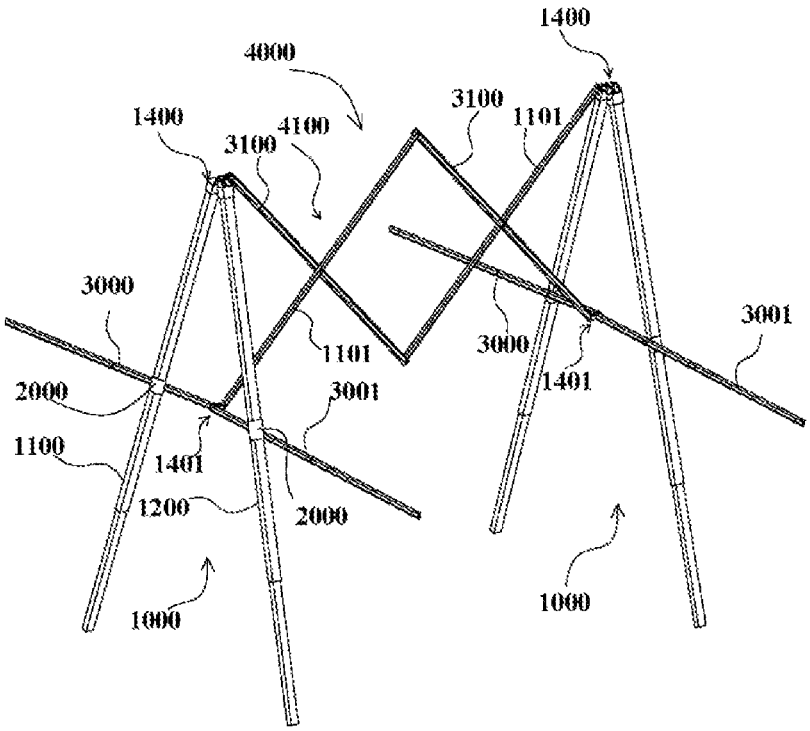
FIG. 21 shows a schematic view of embodiment XVII.

As shown in FIGS. 21, it discloses a collapsible structure, wherein it comprises: at least two standing frames 1000, each standing frame 1000 consisting of two standing poles: the first standing pole 1100 and the second standing pole 1200, which are pivotally connected at the top through a first pivot point 1400. The first standing pole 1100 and the second standing pole 1200 of each standing frame 1000 further include sliding members 2000 that can slide along them. The standing frame 1000 also includes first bracing pole 3000 and second bracing pole 3001, which are pivotally connected to the sliding members 2000 on the first standing pole 1100 and the second standing pole 1200, respectively. The inner ends of the first bracing pole 3000 and the second bracing pole 3001 are pivotally connected together through a second pivot point 1401.

In this embodiment, an extendable linkage 4000 is provided between two adjacent standing frames 1000, allowing them to close up or extend out. The first end of the extendable linkage 4000 is connected to the first pivot point 1400 and the second pivot point 1401 of one standing frame 1000, while the second end is connected to the first pivot point 1400 and the second pivot point 1401 of another standing frame 1000. The canvas also attached to this collapsible structure, connects the apex of the standing frame 1000 and the free ends of first bracing pole 3000 and the second bracing pole 3001. In addition to providing shade, the canvas acts as pulling vehicle for the first bracing pole 3000 and the second bracing pole 3001.

Therefore, in this embodiment, when two standing frames 1000 move closer to each other, the extendable linkage 4000 folds. It then drives the second pivot points 1401 and the sliding member 2000 away from the first pivot points 1400, causing the first bracing pole 3000, the second bracing pole 3001, the first standing pole 1100, and the second standing pole 1200 to rotate and fold accordingly. When two standing frames 1000 move away from each other, the extendable linkage 4000 unfolds. It drives the second pivot points 1401 and the sliding members 2000 toward the first pivot points 1400, causing the bracing poles and standing poles to rotate and unfold accordingly. The rest of the structure is the same as in the embodiment XV and will therefore not be repeated.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also considered to be within the protection scope of the present invention.

The invention has now been described in detail for the purposes of clarity and understanding. Those skilled in the art will appreciate that certain changes and modifications may be made within the scope of the appended claims.

Conditional language used herein, such as, but not limited to, "can," "could," "might," "may," "e.g.," and the like, unless specifically stated otherwise, or otherwise understood within the context as used, is generally intended to convey that certain examples include, while other examples do not include, certain features, elements, and steps. Thus, such conditional language is not generally intended to imply that features, elements and steps are in any way required for one or more examples or that one or more examples necessarily include logic for deciding, with or without author input or prompting, whether these features, elements and steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A collapsible structure comprising:

at least two standing frames connected by an extendable linkage, said extendable linkage allows the at least two standing frames to be closed or extended;

wherein each of said at least two standing frames has;

two standing poles, comprising a first standing pole and a second standing pole, wherein a top end of said first standing pole and a top end of said second standing pole are connected by a pivot point, allowing said two standing poles to rotate about said pivot point and to be folded or unfolded;

a sliding member mounted to the first standing pole and configured to slide on said first standing pole, able to move along a length thereof; and a link pole, one end of which is pivotally connected to said sliding member and a second end thereof is pivotally connected to said second standing pole;

wherein each of said at least two standing frames is configured such that when said first standing pole of the respective standing frame is folded towards said second standing pole of the respective standing frame, said link pole of the respective standing frame rotates around the second end thereof, and drives said sliding member of the respective standing frame away from said pivot point of the respective standing frame along said first standing pole of the respective standing frame until the two standing poles of the respective standing frame are completely folded up; and when said first standing pole of the respective standing frame is opened up from said second standing pole of the respective standing frame, said link pole of the respective standing frame rotates accordingly and drives said sliding member of the respective standing frame towards said pivot point of the respective standing frame along said first standing pole of the respective standing frame until the two standing poles of the respective standing frame are completely unfolded.

2. The collapsible structure of claim 1, wherein said extendable linkage further comprises at least one extendable link assembly, a middle of said at least one extendable link assembly is pivotally connected to adjust a distance between two ends thereof; and the two ends of said extendable linkage are each pivotally connected to a respective said pivot point of a respective standing frame of said at least two standing frames adjacent to said extendable linkage.

3. The collapsible structure of claim 1, wherein said extendable linkage comprises at least one extendable link assembly, and said at least one extendable link assembly includes at least a pair of link members connected in an X-shaped configuration by a central pivot, wherein the pair of link members is a first link member and a second link member, wherein said first link member is pivotally connected to said pivot point of a first standing frame of said at least two standing frames by a first end thereof and to said sliding member on a second standing frame of said at least two standing frames by a second end thereof, and wherein said second link member is pivotally connected to said sliding member on the first standing frame at a first end thereof and to said pivot point of the second standing frame at a second end thereof.

4. The collapsible structure of claim 1, wherein each of said at least two standing frames comprises two sliding members, wherein the sliding member mounted to the first standing pole of the respective standing frame is one of said two sliding members, and the other of said two sliding members is a sliding member mounted to and configured to slide along the second standing pole of the respective standing frame;

wherein said extendable linkage comprises two extendable link assemblies, wherein each of the two extendable link assemblies is located on a respective side of said standing frames;

wherein each of said extendable link assemblies further comprises:

at least a pair of link members connected together in an X-shaped configuration by a central pivot, wherein said at least a pair of link members comprises a first link member and a second link member;

wherein in a first extendable link assembly of the two extendable link assemblies, one end of said first link member is connected to said pivot point of a first standing frame of said at least two standing frames, while another end of said first link member is connected to a first sliding member of said two sliding members on a second standing frame of said at least two standing frames, wherein one end of said second link member is connected a first sliding member of said two sliding members on the first standing frame, and another end of said second link member is connected to said pivot point of the second standing frame; and wherein in a second extendable link assembly of the two extendable link assemblies, one end of said first link member is connected to said pivot point of the first standing frame, while another end of said first link member is connected to a second sliding member of said two sliding members on the second standing frame, wherein one end of said second link member is connected a second sliding member of said two sliding members on the first standing frame, and another end of said second link member is connected to said pivot point of the second standing frame.

5. The collapsible structure of claim 1, wherein said sliding member is further equipped with a locking member, and said locking member enables said sliding member to be locked in any position during travel thereof.

6. The collapsible structure of claim 1, wherein the extendable linkage comprises two extendable link assemblies positioned in a sequence along an extending direction of the at least two standing frames, wherein each of the extendable link assemblies includes a first link member and a second link member connected to each other in an X-shaped configuration by a central pivot;

wherein an upper end of the first link member in a first extendable link assembly of the two extendable link assemblies is pivotally connected to said pivot point of a first standing frame of the at least two standing frames, while a lower end of said second link member in said first extendable link assembly is pivotally connected to said sliding member of said first standing frame; and a lower end of said first link member in said first extendable link assembly is pivotally coupled to a lower end of said second link member in a second extendable link assembly of the two extendable link assemblies; and an upper end of said second link member in the first extendable link assembly is pivotally coupled to an upper end of said first link member in said second extendable link assembly; and the lower end of said first link member in said second extendable link assembly is pivotally connected to said sliding member of a second standing frame of the at least two standing frames, while the upper end of said second link member in said second extendable link assembly is pivotally connected to said pivot point of said second standing frame.

7. A collapsible structure comprising:

at least two standing frames, each standing frame consisting of two standing poles: a first standing pole and a second standing pole, which are pivotally connected at a top through a first pivot point, wherein said first standing pole is pivotally connected with a first bracing pole, and the second standing pole is pivotally connected with a second bracing pole, and inner ends of said first bracing pole and said second bracing pole are pivotally connected together through a second pivot point;

wherein for each standing frame:

said first standing pole includes a sliding member, said second standing pole includes a sliding member; said first bracing pole is pivotally connected to the sliding member of the first standing pole; and said second bracing pole is pivotally connected to the sliding member of the second standing pole; and an extendable linkage is provided between the at least two standing frames, to provide for closure or extension, wherein a first end of said extendable linkage is connected to said first pivot point and said second pivot point of a first standing frame of the at least two standing frames, a second end of said extendable linkage is connected to said first pivot point and said second pivot point of a second standing frame of the at least two standing frames;

said extendable linkage is folded, for:

each standing frame of the at least two standing frames is configured such that when said extendable linkage drives said second pivot point of the respective standing frame away from said first pivot point of the respective standing frame, causing said bracing poles of the respective standing frame and said standing poles of the respective standing frame to rotate and fold accordingly, and when said extendable linkage is unfolded, said extendable linkage drives said second pivot point of the respective standing frame towards said first pivot point of the respective standing frame, causing said bracing poles of the respective standing frame and said standing poles of the respective standing frame to rotate and unfold accordingly.

8. The collapsible structure of claim 7, wherein said extendable linkage has at least one extendable link assembly that includes at least one pair of a first link member and a second link member connected together in an X-shaped configuration by a respective central pivot, wherein upper ends of said extendable linkage are pivotally linked to said first pivot point of said at least two standing frames, while lower ends of said extendable linkage are pivotally linked to said second pivot points of said at least two standing frames.

9. The collapsible structure of claim 7, wherein said extendable linkage further comprises two extendable link assemblies positioned in a sequence along an extending direction, wherein each extendable link assembly includes link members connected in an X-shaped configuration by a central pivot; and an upper end of a first link member in a first extendable link assembly of said two extendable link assemblies is pivotally connected to said first pivot point of said first standing frame, a lower end of a second link member in the first extendable link assembly is pivotally connected to said second pivot point of said first standing frame, and a lower end of said first link member in said first extendable link assembly is pivotally coupled to a lower end of said second link member in a second extendable link assembly of said two extendable link assemblies through a fourth pivot point, and an upper end of said second link member in said first extendable link assembly is pivotally coupled to an upper end of said first link member in said second extendable link assembly through a third pivot point, and a lower end of said first link member in said second extendable link assembly is pivotally connected to said second pivot point of said second standing frame, while an upper end of said second link member in said second extendable link assembly is pivotally connected to said first pivot point of said second standing frame.

10. The collapsible structure of claim 9, wherein said extendable linkage is pivotally connected with a first support pole and a second support pole on each side, wherein said first support pole is connected to said third pivot point, while said second support pole is connected to said fourth pivot point, and another end of said second support pole is connected to said first support pole.

11. The collapsible structure of claim 9, wherein a locking device is provided between said first and second pivot points of said standing frame to allow said second pivot point to remain in place when said structure is unfolded, alternatively a locking device may be provided on said extendable linkage to keep said extendible linkage in position when extended.

12. The collapsible structure of claim 7, wherein outer ends of said first and second bracing poles extend out from said standing frames to create connecting portions for a canvas.

13. The collapsible structure of claim 7, wherein the collapsible structure consists of two standing frames, and upper ends of the two standing frames are closer together than lower ends of the two standing frames, wherein each standing frame has said first and second pivot points which are vertically aligned.

14. The collapsible structure of claim 7, wherein for each standing frame said first and second pivot points are vertically aligned, each standing frame also having a side extension pole and a side bracing pole attached to an outer side thereof, an upper end of said side extension pole pivoting to said first pivot point of said standing frame while one end of said side bracing pole pivots to said second pivot point of said standing frame, and another end of said side bracing pole pivots to said side extension pole.

15. The collapsible structure of claim 7, which further comprises two standing frames, said first and second pivot points of each standing frame being vertically aligned, each standing frame also having a third standing pole and a third bracing pole located on an outer side, an upper end of said third standing pole being pivotally connected to said first pivot point of said standing frame, while a lower end is level with said first and second standing poles, one end of said third bracing pole being pivotally connected to said second pivot point of said standing frame, and another end being pivotally connected to said third standing pole.

16. The collapsible structure of claim 7, wherein each of said standing frames is provided with two pull poles, each corresponding to said first and second bracing poles, upper ends of the pull poles being connected to said first pivot point, while said pull poles are pivotally connected to said first and second bracing poles correspondingly.

* * * * *